US006996361B2

(12) United States Patent
Ichida et al.

(10) Patent No.: US 6,996,361 B2
(45) Date of Patent: Feb. 7, 2006

(54) FULL-COLOR ELECTROPHOTOGRAPHIC APPARATUS USING LIQUID TONER CONTAINING RESIN

(75) Inventors: Motoharu Ichida, Tsubata-machi (JP); Satoshi Moriguchi, Kanazawa (JP); Yasuhiko Kishimoto, Uchinada-machi (JP); Masanobu Hongo, Unoke-machi (JP); Shigeki Uesugi, Unoke-machi (JP); Yoshiro Kawamoto, Kanazawa (JP); Seiichi Takeda, Kanazawa (JP); Tadasuke Yoshida, Uchinada-machi (JP); Yoshiaki Fujimoto, Kanazawa (JP); Jiyun Du, Kanazawa (JP); Hironaga Hongawa, Uchinada-machi (JP); Eri Yamanishi, Hakui (JP); Tatsuo Nozaki, Unoke-machi (JP); Shigeharu Okano, Hakui (JP); Isao Nagata, Tsubata-machi (JP)

(73) Assignee: PFU Limited, Ishikawa (JP)

( * ) Notice: Subject to any disclaimer, the term of this patent is extended or adjusted under 35 U.S.C. 154(b) by 0 days.

(21) Appl. No.: 10/481,567

(22) PCT Filed: Jan. 28, 2003

(86) PCT No.: PCT/JP03/00764

§ 371 (c)(1),
(2), (4) Date: Dec. 22, 2003

(87) PCT Pub. No.: WO03/065128

PCT Pub. Date: Aug. 7, 2003

(65) Prior Publication Data

US 2004/0175208 A1 Sep. 9, 2004

(30) Foreign Application Priority Data

| | | |
|---|---|---|
| Jan. 30, 2002 | (JP) | 2002-021063 |
| Feb. 26, 2002 | (JP) | 2002-049241 |
| May 1, 2002 | (JP) | 2002-129828 |
| May 24, 2002 | (JP) | 2002-150470 |
| Jun. 4, 2002 | (JP) | 2002-162263 |

(51) Int. Cl.
*G03G 15/01* (2006.01)

(52) U.S. Cl. ..... 399/302; 399/390

(58) Field of Classification Search ..... 399/302, 399/307, 308, 237, 320, 390
See application file for complete search history.

(56) References Cited

U.S. PATENT DOCUMENTS 5,882,828 A 3/1999 Kato et al.

(Continued)

FOREIGN PATENT DOCUMENTS

JP 07-311505 11/1995

(Continued)

*Primary Examiner*—Quana Grainger
(74) *Attorney, Agent, or Firm*—Staas & Halsey LLP

(57) ABSTRACT

A full-color electrophotographic apparatus of the present invention is configured such that a toner image is formed on an intermediate transfer member. The intermediate transfer member is heated to a temperature equal to or higher than the softening start temperature of resin contained in a liquid toner and equal to or lower than the withstand temperature of a photoconductor member. A carrier-removing roller to which bias can be applied abuts the intermediate transfer member so as to remove a carrier while packing softened toner by the force of an electric field induced by bias. In a transfer section for transfer to a printing medium, a backup roller presses the printing medium against the intermediate transfer member, and the toner image is transferred from the intermediate transfer member to the printing medium. Before being pressed against the toner image on the intermediate transfer member, the printing medium is heated. Bias is applied to the backup roller such that the toner image on the intermediate transfer is attracted toward the printing medium by the action of an electric field, thereby assisting transfer. By so doing, the intermediate transfer member does not need to undergo cooling before coming into contact with the photoconductor member, thereby avoiding occurrence of thermal damage to the photoconductor member.

14 Claims, 23 Drawing Sheets

U.S. PATENT DOCUMENTS

| | | | | |
|---|---|---|---|---|
| 6,173,147 | B1 | 1/2001 | Nakashima et al. | |
| 6,259,880 | B1 * | 7/2001 | Jia et al. | 399/307 |
| 6,308,034 | B1 | 10/2001 | Nakashima et al. | |
| 6,356,731 | B1 | 3/2002 | Shinjo | |
| 6,377,773 | B1 * | 4/2002 | Berkes et al. | 399/307 |
| 2004/0191664 | A1 * | 9/2004 | Hosoi et al. | 430/124 |

FOREIGN PATENT DOCUMENTS

| | | | |
|---|---|---|---|
| JP | 2000-305385 | | 11/2000 |
| JP | 2001-022186 | | 1/2001 |
| JP | 2001-060045 | | 3/2001 |
| JP | 2001-060046 | | 3/2001 |
| JP | 2001-092199 | | 4/2001 |
| JP | 2001-305886 | | 11/2001 |
| JP | 2001305887 A | * | 11/2001 |
| JP | WO 01/82003 A1 | | 11/2001 |

* cited by examiner

Apply Bias Voltage ranging from 500V to 5KV

Fig.8

| Printing Medium Thickness | Surface Roughness | Regulated Solid Proportion (%) | Transfer Pressure (MPa) | Transfer Bias Voltage (V) | Fixation Pressure (MPa) | Fixation Temperature (℃) |
|---|---|---|---|---|---|---|
| Thin | Fine | 90 | 1 | 2000 | 0.5 | 120 |
| Thin | Coarse | 90 | 1 | 2000 | 2 | 120 |
| Thick | Fine | 50 | 0.5 | 3000 | 0.5 | 150 |
| Thick | Coarse | 50 | 0.5 | 3000 | 2 | 150 |

Preheating Unit

Another Example of Preheating Unit

Speed Setting of Belt used in Preheating Unit (A)

| Nip Width (mm) | Set Temperature (°C) | Distance after Passing Preheating Unit (mm) | | | |
|---|---|---|---|---|---|
| | | 10 | 60 | 90 | 120 |
| 2.5 | 150 | 75 | 55 | 55 | 55 |
| 5 | 150 | 82 | 70 | 66 | 65 |
| 7 | 150 | 93 | 85 | 80 | 80 |

(B)

Relationship between Nip Width and Distance to Melt Transfer Section when Preheating Unit is set to 150°C

Fig.16

| | Toner A | Toner B | Toner C | Toner D | Toner E |
|---|---|---|---|---|---|
| Tg1/% | 62℃/74% | 85℃/40% | 92℃/35% | 85℃/35% | 92℃/35% |
| Tg2/% | — | 45℃/32% | 45℃/35% | 62℃/35% | 62℃/35% |
| Tg3/Tm3 | 53℃/87℃ | 47℃/88℃ | 52℃/94℃ | 52℃/92℃ | 58℃/96℃ |

Fig.17

| | Intermediate Transfer Member Temperature | T4−Tg1 | Tg2−T4 | Transfer Efficiency | | |
|---|---|---|---|---|---|---|
| | | | | Carrier Removal Count | | |
| | | | | 1 | 2 | 3 |
| Toner A | 60 | −2 | — | ○ | × | ×× |
| | 70 | 8 | — | × | — | — |
| Toner B | 60 | 15 | 25 | ○ | △ | × |
| | 70 | 25 | 15 | △ | — | — |
| | 80 | 35 | 5 | × | — | — |
| Toner C | 60 | 15 | 32 | ○ | ○ | △ |
| | 70 | 25 | 22 | △ | — | — |
| | 80 | 35 | 12 | × | — | — |
| Toner D | 60 | −2 | 25 | △ | — | — |
| | 70 | 8 | 15 | ○ | △ | × |
| | 80 | 18 | 5 | △ | — | — |
| Toner E | 60 | −2 | 32 | × | — | — |
| | 70 | 8 | 22 | ○ | ○ | ○ |
| | 80 | 18 | 12 | ○ | △ | × |

Transfer Efficiency : ○(Excellent)→△(Good)→×(Poor)→××(Worst)

Toner Surface Tempetature History in Fixation Nip Zone (Example)

Printing Medium Temperature History in Fixation Nip Zone of Heating Roller Structure (Example)

(A) Heating Roller Material : Heating Roller Surface is covered with Rubber (B) Heating Roller Material : Fluorine-Containing Resin Coat is applied to Aluminum Pipe Surface Toner and Printing Medium Surface Temperature History in Fixation Nip Zone (Example)

FULL-COLOR ELECTROPHOTOGRAPHIC APPARATUS USING LIQUID TONER CONTAINING RESIN

TECHNICAL FIELD

The present invention relates to a full-color electrophotographic apparatus using a nonvolatile, high-viscosity, high-concentration liquid toner in which color-liquid toners in a plurality of colors are sequentially superposed on an intermediate transfer member so as to form a full-color image, and the full-color image is heat-melt-transferred to a printing medium.

BACKGROUND ART

In addition to having a function of preventing scattering in the air of toner particles having a size of about 1 μm, the carrier liquid of a liquid toner (liquid developer) has a function of bringing toner particles in a charged, uniformly dispersed state. In development and electrostatic transfer processes, the carrier liquid plays a role for facilitating electrophoresis of toner particles under the action of an electric field.

For example, in a liquid development printer process, a carrier liquid is a component required for storage of toner, conveyance of toner, layer formation, development, and electrostatic transfer. However, during and after the process of fixation on printing medium, the carrier liquid is unnecessary in terms of image quality and the like. For these reasons, volatile, electrically insulative solvents are currently used as carrier liquids of many liquid toners. When a volatile carrier liquid is used, the carrier liquid is volatilized and removed from a toner image through application of heat at the time of fixation. Since a hydrocarbon solvent is usually used as the volatile carrier liquid, in light of influence on the human body, the volatilized carrier liquid must be collected so as to prevent release to the exterior of the apparatus. Thus, a large-scale collection apparatus is required.

In order to cope with firm adhesion of toner to the interior of the apparatus as a result of volatilization of solvent, influence of a volatilized carrier on the human body, and environmental problems induced by the volatilized carrier, liquid toners that use a nonvolatile carrier solvent have been developed. Among them is HVS (High Viscous Silicone-oil) toner.

In a liquid-development apparatus using a nonvolatile carrier liquid, a toner image formed on an intermediate transfer member is heated, and the carrier liquid is removed, whereby the nonvolatile carrier liquid can be effectively removed. Through such removal of the carrier liquid, while wetting of a printing medium and a fixation defect which might otherwise result from the carrier liquid are prevented, a toner image can be transferred and fixed to the printing medium.

FIG. 27 shows a conventional liquid-development electrophotographic apparatus. In the illustrated apparatus, a photoconductor member is charged by means of a charger, and optical exposure of a printing image is effected by an exposure unit so as to form an electrostatic latent image on the surface of the photoconductor member. A developing unit is configured such that a liquid toner is used as developer; the liquid toner is thinly applied to a developing roller; and the developing roller is in contact with the photoconductor member. The electric field force of the electrostatic latent image formed on the surface of the photoconductor member causes toner particles of the liquid toner on the developing roller to adhere to the electrostatic latent image.

The thus-formed toner image on the photoconductor member is transferred to an intermediate transfer member. After transfer of the toner image to the intermediate transfer member, the photoconductor member is destaticized by means of a destaticizer, and then undergoes formation of the next image. The toner image transferred to the intermediate transfer member is transferred to a printing medium. At the time of this transfer, the toner image on the intermediate transfer member is heated so as to be sufficiently melted.

In such a liquid-development electrophotographic apparatus, in order to lessen thermal damage to the photoconductor member, the intermediate transfer member must undergo cooling before coming into contact with the photoconductor member. This requires a large quantity of energy (refer to Japanese Patent Application Laid-Open Nos. 2001-22186 and 2001-305886).

In order to avoid damage to the photoconductor member which would otherwise result from the photoconductor member being heated through contact with the intermediate transfer member which has been heated at the time of transfer to the printing medium, after transfer to the printing medium, the intermediate transfer member must undergo cooling. In order to enable this cycle of heating and cooling, the intermediate transfer member must be of sufficiently large size in order to render time before cooling sufficiently long, resulting in an increase in the size of the apparatus. Also, repeating heating and cooling requires a large quantity of energy.

Also, in the conventional liquid-development electrophotographic apparatus, pressure to be imposed on the printing medium raises a problem. A toner image is transferred from the intermediate transfer member to the printing member by means of electrostatic transfer effected through application of voltage. Since electrostatic transfer is influenced by the electric resistance of the printing medium, it is highly dependent on environmental factors such as ambient temperature and humidity, thereby imposing limitations on environmental specifications of the electrophotographic apparatus.

In order to solve the above problem, there has been employed a melt transfer-and-fixation process in which toner is brought in a molten state so as to attain adhesion, and the molten toner is transferred to a printing medium. Specifically, as shown in FIG. 28, the intermediate transfer member and a backup roller are heated by means of a heater so as to melt a toner image on the intermediate transfer member, and then the molten toner image is transferred to the printing medium through application of pressure effected by the backup roller.

In this case, dependence on environmental factors can be lowered. However, since adhesion of toner is used for transferring a toner image to the printing medium, transfer pressure must be extremely high (1 MPa or higher). This raises the following problem: vibration generated on the intermediate transfer member when the printing medium is nipped in a contact section between the backup roller and the intermediate transfer member is transmitted to the photoconductor member and the developing units, which are drivingly linked to the intermediate transfer member, thereby causing generation of image distortion called shock marks. Also, as a result of subjection to excessive pressure in the contact section between the backup roller and the intermediate transfer member, toner which remains on the intermediate transfer member without being transferred to the printing medium at the time of transfer of a toner image firmly adheres to the surface of the intermediate transfer member; and a cleaning unit encounters difficulty in removing the residual toner.

Furthermore, in the liquid-development electrophotographic apparatus, presence of excess carrier at the time of transfer to the intermediate transfer member or paper affects melting of a toner layer at the time of fixation, and causes a fractural separation of the toner layer at the exit of a nip zone at the time of transfer, with a resultant disturbance of image due to generation of a streaky pattern called riblet (ribs).

Thus, excess carrier liquid must be removed. However, in contrast to the case where a volatile carrier liquid is used, in the case where a nonvolatile, high-viscosity, high-concentration liquid toner is used as developer, a carrier cannot be removed through vaporization. Thus, removal of carrier is performed on the photoconductor member at a position located downstream of a development position and on the intermediate transfer member.

In order to enhance transfer efficiency, Japanese Patent Application Laid-Open (kokai) No. 2001-60046 discloses the technique of increasing adhesion between toner particles and a printing medium through employment of temperature settings represented by the relation "surface temperature of an image bearing member≦glass transition point of toner particles<temperature of a printing medium."

However, when the surface temperature of an image bearing member is set lower than the glass transition point of toner particles, toner solids tend to hold the carrier, thereby impairing the carrier removal efficiency. As a result, after transfer to a medium, a fixation defect arises.

Similarly, according to Japanese Patent Application Laid-Open (kokai) No. 2001-92199, in order to enhance transfer efficiency, the temperature of an image bearing member and the temperature of a transfer destination member are set higher than the glass transition temperature of a liquid toner.

However, in the case where carrier removal is performed with the surface temperature of the image bearing member being set higher than the glass transition point of toner particles, after sufficient removal of the carrier (in a solid proportion of 50% to 90%), the adhesion between the image bearing member and toner increases. Thus, even when the temperature of the transfer destination member is set higher than the glass transition temperature of toner, transfer efficiency is impaired.

Furthermore, a fixation process in electrophotographic image formation generally employs a fixation process using heating rollers. According to a heat-roller-type fixation process, a printing medium to which a toner image has been transferred in a transfer process passes a nip width which a pair of heat-controlled heating rollers form when they are pressed against each other, whereby thermoplastic toner is heated and melted. This fixation nip zone of the heating rollers simultaneously performs heat transmission to a toner image for melting the toner image, and application of pressure to the toner image for close contact of the toner image with and penetration of the toner image into the printing medium. As a result, final image strength, such as strength of adhesion to the printing medium or resin strength, is developed.

However, in the heat-roller-type fixation process, since toner is heated to a temperature equal to or higher than its melt temperature Tm [° C.], a problem called "high-temperature offset" may occur. The "high-temperature offset" is a phenomenon in which molten toner adheres to a heating roller, because of insufficient toner cohesion caused by the decreased viscosity of the molten toner. According to general measures to cope with the problem, the surface of a heating roller—which comes in direct contact with a toner image—is formed of a fluorine-containing resin coat or silicone rubber of excellent parting performance and is additionally coated with a parting oil typified by silicone oil.

These measures can lower adhesion to a heating roller and thus yield the desired effect to a certain extent, but raise a new problem. For example, when silicone oil serving as a parting oil is applied to the surface of a heating roller, depending on the quantity of application, a printing medium, such as paper, becomes translucent because of wetting, or excessive gloss or glare is imparted to an image, thereby developing a wrong representation of image quality. In some cases, silicone oil itself may hinder melt integration of toner.

FIG. 29 shows a conventional toner fixation unit for use in a full-color electrophotographic apparatus. Referring to FIG. 29, generally, in a full-color electrophotographic apparatus, in order to obtain good color development, toner is completely melted and fixed on a printing medium. In order to completely melt and fix toner on the printing medium, toner and the printing medium are heated to the melting temperature of toner in the fixation nip zone of paired fixation rollers consisting of a heating roller for heating the image side of the printing medium and a backup roller to apply pressure to the printing medium; and molten toner is brought in close contact with the printing medium through application of pressure from the paired fixation rollers. Accordingly, when printing speed increases through attainment of high-speed rotation of paired feed rollers for feeding the printing medium, time for the printing medium to pass through the fixation nip zone is shortened, thereby raising difficulty in raising the temperature of the printing medium.

Also, molten toner exhibits an increase in adhesiveness and thus adheres not only to the printing medium but also to a heating roller (high-temperature offset). This adhesion to a heating roller must be avoided. According to the prior art illustrated in FIG. 29, in order to wipe off adhering toner from the heating roller, a cleaning belt and a cleaning roller are provided. Generally, in order to hinder high-temperature offset of toner to the heating roller, silicone oil having a viscosity of about 50 cSt to 100,000 cSt is applied as a parting agent to the heating roller at all times by means of an oil application roller or the like. This raises another problem of adhesion of a large quantity of silicone oil to the printing medium.

FIG. 30 is a diagram illustrating a toner and printing medium surface temperature history as observed in a fixation nip zone. In FIG. 30, Tg represents glass transition temperature; Tm represents the melting point of the resin component of toner particles; and Toff represents an upper-limit temperature at and below which high-temperature offset does not occur. The cause of high-temperature offset in a heat-roller-type fixation process is as follows. As illustrated in FIG. 30, a toner image on the printing medium is of low temperature at the entrance of the nip zone and is heated through heat transmission from a high-temperature heating roller. Thus, the highest temperature is marked at the exit of the nip zone of the heating roller. At this time, the temperature rises above the high-temperature-offsetless upper limit temperature Toff, thereby causing occurrence of high-temperature offset. As described above, high-temperature offset occurs when the temperature as measured at the exit of the nip zone exceeds Toff. Thus, the general fixation process—in which the temperature as measured at the exit of the nip zone marks a highest value in temperature history—is disadvantageous in terms of high-temperature offset.

DISCLOSURE OF THE INVENTION

An object of the present invention is to provide a full-color electrophotographic apparatus which, through use of a nonvolatile carrier liquid, can effectively remove the carrier liquid without need to employ a large-scale collection apparatus and can effectively transfer a full-color image to a printing medium.

Another object of the present invention is to avoid a need to cool an intermediate transfer member before the intermediate transfer member comes into contact with a photoconductor member, through separation, from a transfer section, of a fixation section which generates a large quantity of heat, thereby avoiding heat damage to the photoconductor member.

Still another object of the present invention relates to transfer and fixation, to a printing medium, of a toner image formed on an intermediate transfer member, and is to ensure sufficient transfer efficiency and fixation strength even when pressure to be applied to the printing medium at the time of melt transfer is slight.

A further object of the present invention is to stably and efficiently melt-transfer to a printing medium an image which is formed on an intermediate transfer member and from which a carrier is sufficiently removed.

A still further object of the present invention is to fix toner to a printing medium without involvement of high-temperature offset (adhesion of molten toner to a heating roller) in a fixation process, through improvement of temperature history conditions in the fixation nip zone of fixation rollers including a mechanism for heating toner and the printing medium.

The present invention is based on the findings that a toner image can be melt-transferred to a printing medium at a temperature lower than that for fixation, and a carrier can be removed to a sufficient level at a temperature lower than the temperature for melt transfer. The present invention is configured as follows: a toner image on an intermediate transfer member is heated at a temperature equal to or higher than the softening start temperature of toner resin (resin) and equal to or lower than the withstand temperature of a photoconductor member; and a carrier-removing roller to which bias is applied is brought in rotary contact with the toner image on the intermediate transfer member to thereby remove a carrier while toner solids are pressed against the intermediate transfer member by means of the force of an electric field. The softening start temperature of the resin means a temperature at which a needle begins to move in measurement by TMA; and the melt temperature of the resin means a temperature at which the movement of the needle settles in the course of measurement by TMA. The withstand temperature of the photoconductor member can be the glass transition point of bind resin used in the photoconductor member or a temperature at which the bind resin mechanically deforms. TMA (thermomechanical analyzer) is a general measuring apparatus for measuring the mechanical strength to heat of material (mainly resin) and is used as follows: while heat is applied to a sample, the mechanical strength of the sample is measured from displacement of a probe.

The full-color electrophotographic apparatus of the present invention is configured such that a toner image is formed on an intermediate transfer member. The intermediate transfer member is heated to a temperature equal to or higher than the softening start temperature of resin contained in a liquid toner and equal to or lower than the withstand temperature of a photoconductor member. A carrier-removing roller to which bias can be applied abuts the intermediate transfer member so as to remove a carrier while packing softened toner by the force of an electric field induced by the bias. In a transfer section for transfer to a printing medium, a backup roller presses the printing medium against the intermediate transfer member, and the toner image is transferred from the intermediate transfer member to the printing medium. Before being pressed against the toner image on the intermediate transfer member, the printing medium is heated. Bias is applied to the backup roller such that the toner image on the intermediate transfer is attracted toward the printing medium by the action of an electric field, thereby assisting transfer.

Furthermore, in order to obtain a final fixation strength, the toner image transferred to the printing medium is fixed through application of heat effected by a fixation unit.

BRIEF DESCRIPTION OF DRAWINGS

FIG. 8 is a table for explaining optimum parameter values according to types of printing media;

FIG. 16 is a table showing the softening temperatures (Tg1 and Tg2) of resins contained in each of toners (toners A to E), the mixing proportions of the resins, and the softening temperature (Tg3) and the melting temperature (Tm3) of each toner serving as a mixed-resin toner;

FIG. 17 is a table showing the results of studying the transfer efficiency of transfer from an intermediate transfer member to a printing medium by use of the toners of FIG. 16 while the intermediate transfer member temperature T4 and a carrier removal count are varied;

BEST MODE FOR CARRYING OUT THE INVENTION

Figure 1:
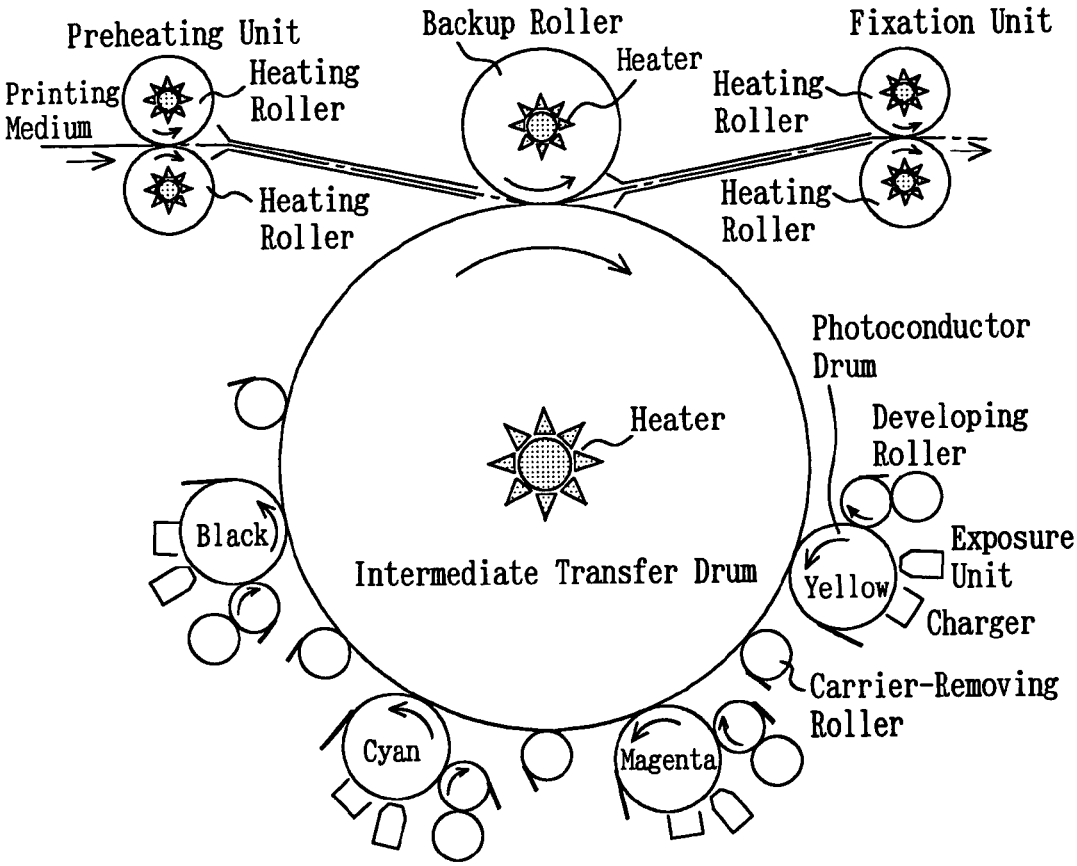
FIG. 1 is a view illustrating the configuration of a full-color electrophotographic apparatus which embodies the present invention.

FIG. 1 is a view illustrating the configuration of a full-color electrophotographic apparatus which embodies the present invention. A nonvolatile liquid toner used in the apparatus uses a nonvolatile silicone oil as a carrier and has a viscosity of 10 cSt to 200 cSt, preferably 50 cSt to 100 cSt. The silicone oil contains, in a dispersed condition, toner particles consisting of resin and pigment and having a particle size of about 1 $\mu$m to 2 $\mu$m, in a proportion of about 10% to 30%, preferably 10% to 20%.

An intermediate transfer member can assume the form of either a drum or a belt. In view of stable superposition of colors, the illustrated apparatus employs a drum-shaped intermediate transfer member. Photoconductor drums (photoconductor members) corresponding to yellow, magenta, cyan, and black are disposed in an abutting condition around the intermediate transfer member. In this manner, the illustrated apparatus is a tandem full-color electrophotographic apparatus. During a single rotation of the intermediate transfer drum, the intermediate transfer drum comes into contact with the photoconductor members corresponding to the colors, whereby images are sequentially superposed on the intermediate transfer drum, thereby forming a color image.

Each of the photoconductor drums is equipped with a charger for charging the photoconductor drum, an exposure unit, a blade for scraping off residual toner which remains after transfer to the intermediate transfer drum, and the like. A developing roller abuts each of the photoconductor drums.

The charger is adapted to charge the corresponding photoconductor drum to about 700 V. The exposure unit performs exposure on the charged photoconductor drum on the basis of image data by use of, for example, a laser beam having a wavelength of 780 nm. By so doing, an electrostatic latent image is formed on the photoconductor drum such that an exposed portion has an electric potential of about 100 V. Also, an unillustrated destaticizer is provided for removing residual electric potential on the photoconductor drum.

The developing roller is biased to a predetermined voltage of about 400 V to 600 V and supplies positively charged toner to the corresponding photoconductor drum according to an electric field established between the developing roller and the photoconductor drum. By so doing, toner adheres to an exposed portion—which is charged at about 100 V—of the photoconductor drum, whereby an electrostatic latent image on the photoconductor drum is developed into an image. A single or a plurality of toner supply rollers are provided for each color toner and are adapted to apply a nonvolatile, high-concentration, high-viscosity liquid toner containing toner particles in an amount of 10% to 20% to the developing roller at a thickness of 5 $\mu$m to 30 $\mu$m, preferably 5 $\mu$m to 10 $\mu$m. A pattern roller (a known roller having a number of fine grooves formed on its surface) can be used as a toner supply roller for uniformly and stably applying a toner layer to the developing roller. Through utilization of pattern grooves, the pattern roller can measure out and transfer a predetermined amount of liquid toner, thereby applying the toner in the form of a toner layer having a predetermined thickness.

The developing roller can be equipped with an electrically conductive blade such that the blade abuts a toner layer formed on the developing roller at a position located just upstream of a contact position where the rotating developing roller comes into contact with the corresponding photoconductor drum, so as to apply bias to the toner layer. Application of such bias causes toner particles to cohere, whereby carrier oil can be present on the surface of the toner layer. Development in such a state can form a high-quality image free of fogging. Furthermore, the developing roller is equipped with a blade or the like. The blade abuts the developing roller for scraping off residual toner which remains after development.

Toner adhering to each of the photoconductor drums is transferred to the intermediate transfer drum according to an electric field established between the intermediate transfer drum and the photoconductor drum. In order to allow setting of the optimum transfer bias for each of the colors, the shaft of the intermediate transfer drum is grounded, and the optimum transfer bias for each of the colors is applied to the shaft of each of the photoconductor members.

Figure 2:
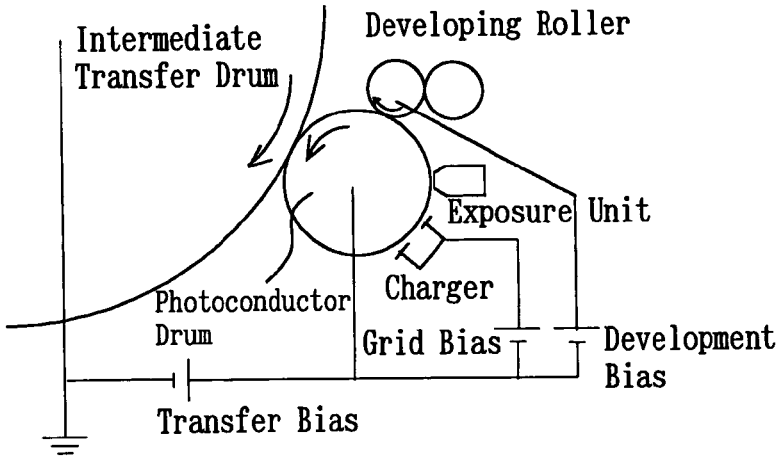
FIG. 2 is a view showing the interrelationship of biases.

FIG. 2 is a view showing the interrelationship of biases. A transfer bias is independently applied to the photoconductor drum of each of the colors in relation to the intermediate transfer drum, which is of the ground potential, so as to become the optimum transfer bias for the color. On the basis of the transfer bias applied to the shaft of the photoconductor drum, a development bias and a charge potential (grid bias) associated with image formation on the photoconductor drum and are set. Furthermore, in the case where a bias blade is provided for causing cohesion of a toner layer on the developing roller, a bias for the blade is set.

Transfer of toner to the intermediate transfer drum is performed, for example, as follows. First, a yellow toner adhering to the first photoconductor drum is transferred. Subsequently, in a transfer section for transfer of a magenta toner, which is the second toner, the magenta toner adhering to the second photoconductor drum is transferred. Then, a cyan toner adhering to the third photoconductor drum is transferred. Finally, a black toner adhering to the fourth photoconductor drum is transferred. In this manner, during a single rotation of the intermediate transfer drum, toner images in four colors developed on the corresponding first to fourth photoconductor drums are sequentially superposed on the intermediate transfer drum, thereby forming a color image.

In this manner, rotation of each of the photoconductor drums causes a toner image developed on the photoconductor drum to come into contact with the intermediate transfer drum, whereby the toner image is transferred to the intermediate transfer drum by means of the force of an electric field. A nonvolatile carrier is present on a color toner image formed on the intermediate transfer drum. If the nonvolatile carrier is transferred intact to a printing medium, a fixation defect will result. Therefore, removal of carrier is performed before transfer to the printing medium.

The intermediate transfer drum is heated by means of a built-in heater and is maintained at a temperature equal to or higher than the softening start temperature of resin contained in the liquid toner and equal to or lower than the withstand temperature of the photoconductor member. Carrier-removing rollers are provided on the intermediate transfer drum downstream of the respective photoconductor drums. Every time a toner image in each of the colors is transferred to the intermediate transfer drum, the corresponding carrier-removing roller—to which a bias of the same polarity as that of toner particles is applied—comes into rotary contact with the toner image on the intermediate transfer drum, thereby removing the carrier while packing softened toner by means of the force of an electric field induced by the bias.

In a transfer section for transfer to a printing medium, a four-color color image on the intermediate transfer drum, which image has been formed through superposition of toner images in four colors and from which the carrier has been removed, is melted through application of heat from the heated intermediate transfer drum and a heater-incorporated backup roller, and the molten image is transferred to the printing medium through press contact.

Bias is applied to the backup roller such that, in transfer of a toner image from the intermediate transfer drum to the printing medium, the toner image is attracted toward the printing medium by the action of an electric field. Subsequently, in a fixation unit, two heating rollers apply pressure to the printing medium, thereby fixing the toner image. In this manner, in order to ensure fixation strength, a color image melt-transferred to the printing medium is subjected to heat of higher temperature and a higher pressure applied by means of the heating rollers. Since the fixation section, which generates a large quantity of heat, is separated from the transfer section, the quantity of heat to be generated in the transfer section can be suppressed to a low level. By use of such a heat fixation mechanism, the toner image transferred to the printing medium is sufficiently heated and can be fixed through application of heat and pressure from the backup roller.

A preheating unit is provided for preheating the printing medium to a temperature higher than a temperature at which toner resin is sufficiently melted, before the printing medium comes into contact with the intermediate transfer drum. When a toner image formed on the intermediate transfer drum is to be transferred to the printing medium in the transfer section, the printing medium must already be preheated to the melting temperature of toner. It is experimentally confirmed that preheating the medium to about 100° C. is preferred. In the illustrated apparatus, a pair of heating rollers is provided and controlled in temperature to 150° C. in order to heat the medium before melt transfer. In order for the heated medium to maintain its temperature when the medium is nipped between the intermediate transfer drum and the backup roller in the melt transfer section, the backup roller is also heated to a temperature equal to or higher than the softening start temperature of toner resin and equal to or lower than the withstand temperature of the photoconductor member. Alternatively, the backup roller may be configured as follows. The backup roller is heated to a temperature equal to or higher than the melting temperature of toner; the backup roller is kept away from the intermediate transfer member unless printing is performed, thereby keeping the intermediate transfer drum away from heat of the backup roller; and only when the printing medium is fed, the backup roller comes into contact with the intermediate transfer member via the printing medium, thereby heating the medium to a temperature required for melt transfer.

Furthermore, bias is applied to the backup roller such that a toner image is attracted to the printing medium from the intermediate transfer drum by the action of an electric field, thereby assisting melt transfer. This bias is supplementally applied for assisting melt transfer. Unless the printing medium is sufficiently heated, adhesion of toner to the medium is weak; and since toner is in the condition of firm adhesion to the intermediate transfer drum, transfer fails to be sufficiently performed.

Figure 3:
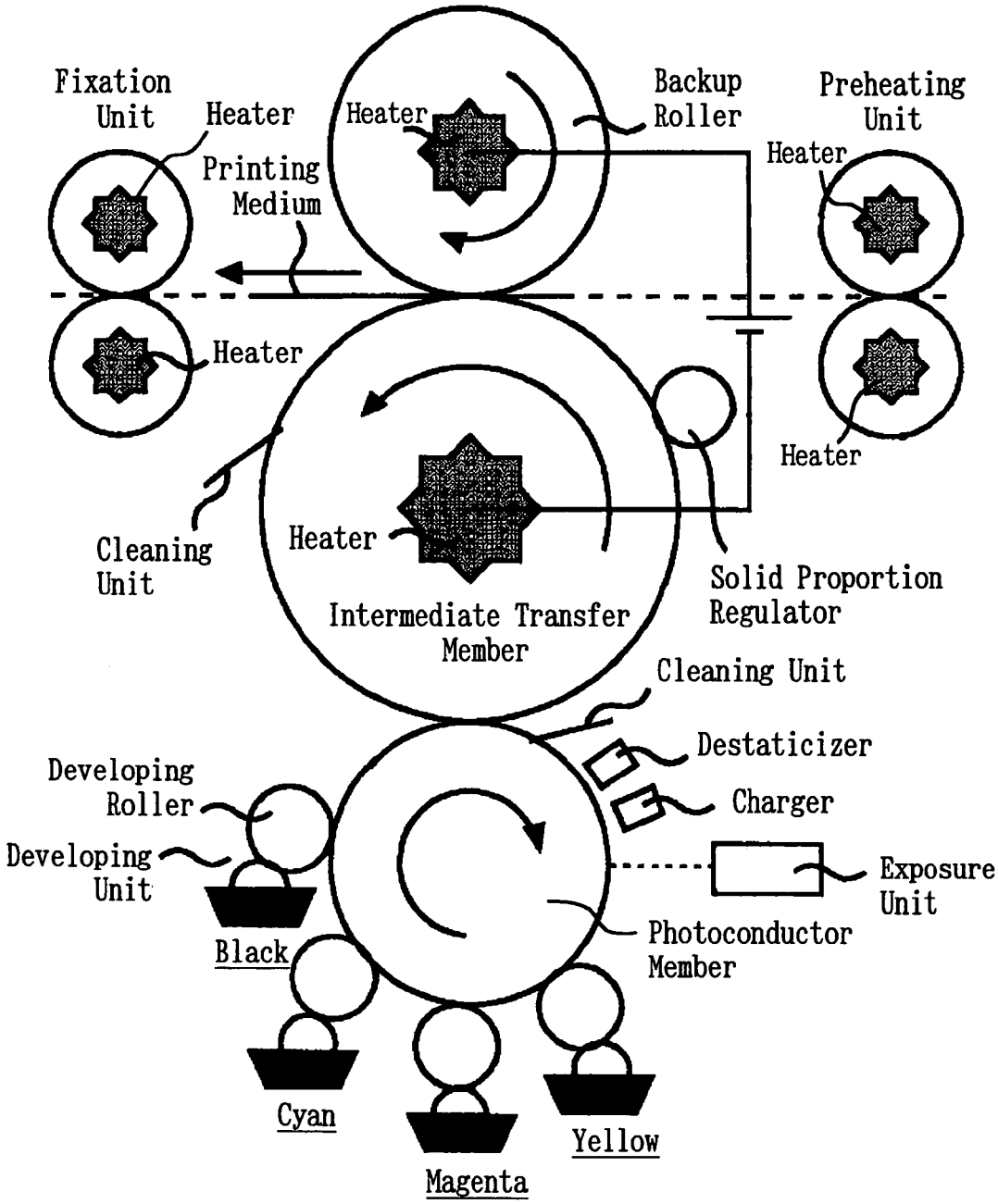
FIG. 3 is a view showing a second example of a full-color electrophotographic apparatus which embodies the present invention.

FIG. 3 is a view showing a second example of a full-color electrophotographic apparatus which embodies the present invention. The illustrated electrophotographic apparatus performs a printing process as follows. After a photoconductor member is charged by means of a charger, the photoconductor member undergoes optical exposure effected by an exposure unit, thereby forming an electrostatic latent image on the surface of the photoconductor member. After the charger charges the photoconductor member to, for example, about 700 V, the exposure unit performs exposure on the charged photoconductor drum on the basis of image data by use of, for example, a laser beam having a wavelength of 780 nm. By so doing, an electrostatic latent image is formed on the photoconductor drum such that an exposed portion has an electric potential of about 100 V. A destaticizer removes residual electric potential on the photoconductor member.

The full-color electrophotographic apparatus is configured such that developing units corresponding to yellow, magenta, cyan, and black are disposed in an abutting condition around the photoconductor member illustrated as a roller. A developing roller of each of the developing units is biased to a predetermined voltage of about 400 V to 600 V and supplies a positively charged toner to the photoconductor member according to an electric field established between the developing roller and the photoconductor member. By so doing, the toner adheres to an exposed portion charged at about 100 V on the photoconductor member, thereby developing an electrostatic latent image on the photoconductor member into a toner image. Specifically, each of the developing units in contact with the photoconductor member functions as follows. A liquid toner is thinly applied to the surface of a developing roller of the developing unit. The developing roller abuts the photoconductor member such that the liquid toner film on the developing roller comes into contact with the electrostatic latent image formed on the surface of the photoconductor member. The force of an electrostatic field established between the electrostatic latent image and the developing roller causes toner particles of the liquid toner on the developing roller to adhere to the electrostatic latent image.

Toner adhering to the photoconductor member is transferred to the intermediate transfer member according to an electric field established between the photoconductor member and the intermediate transfer member. First, for example, a toner image developed in yellow is transferred to the intermediate transfer member during a single rotation of the intermediate transfer member. Similarly, during the next rotation of the intermediate transfer member, a toner image in magenta on the photoconductor member is transferred to the intermediate transfer member in a superposed condition. Furthermore, similarly, toner images in cyan and black are transferred to the intermediate transfer member from the photoconductor member in a superposed condition.

After transfer of toner images to the intermediate transfer member, the photoconductor member has toner remaining on its surface removed by a cleaning unit and is destaticized by a destaticizer, thereby being initialized.

As described above, toner images developed on the photoconductor member are transferred one after another, and the thus-transferred toner images are superposed on one another to thereby be formed into a color image. Usually, every time a toner image in a single color is transferred to the intermediate transfer member, a solid proportion regulator removes the carrier liquid from a toner layer on the intermediate transfer member, thereby regulating the solid proportion. An image formed of a liquid toner on the intermediate transfer member contains a carrier liquid. The solid proportion regulator removes excess carrier oil.

After regulation of solid proportion, the four-color color image on the intermediate transfer member is subjected to application of heat and pressure effected by a heater-incorporated backup roller in a section of contact with a printing medium, thereby being transferred to the printing medium. Before being sent to a transfer section, the printing medium is heated to a temperature required for transfer by use of a preheating unit. The printing medium which has undergone transfer in the transfer section is subjected to a fixation process performed by use of a fixation unit. Residual toner which remains on the intermediate transfer member without being transferred is removed by means of a cleaning unit.

The above-described printing process is performed for printing on the printing medium. In this connection, in order to ensure transfer and fixation to the printing medium without dependence on environmental factors such as ambient temperature and humidity, the present electrophotographic apparatus employs the following configuration.

As shown in FIG. 3, a heater is incorporated in the intermediate transfer member in order to heat a toner image formed on the surface of the intermediate transfer member to a temperature higher than the glass transition temperature of toner solids and lower than the melting point of toner solids. If the toner image is heated to a temperature higher than the melting point of toner solids, the molten toner strongly adheres to the surface of the intermediate transfer member. As a result, the efficiency of transfer to the printing medium drops; and since the molten toner sticks to the surface of the intermediate transfer member, there arises difficulty in cleaning off residual toner.

If the toner image is heated to a temperature lower than the glass transition temperature of toner solids, toner fails to have adhesion, and thus the efficiency of transfer to the printing medium drops. Accordingly, a toner image formed on the intermediate transfer member is heated to a temperature higher than the glass transition temperature of toner solids and lower than the melting point of toner solids, whereby the toner image can be most efficiently transferred to the printing medium, and cleaning off of residual toner is facilitated.

Toner to be used may have a glass transition temperature of toner solids of 60° C. or lower and a melting point of toner solids of 120° C. or lower. This enables the temperature of the intermediate transfer member to be set to 100° C. or lower. Thus, the temperature of the photoconductor member in contact with the intermediate transfer member can be 100° C. or lower, thereby allowing use of a most inexpensive photoconductor member whose withstand temperature is low.

In order to prevent toner heated by the intermediate transfer member from being cooled by the temperature of the backup roller in a section of contact with the backup roller, as shown in FIG. 3, a heater is incorporated in the backup roller; and the backup roller is also heated to a temperature higher than the glass transition temperature of toner solids and lower than the melting point of toner solids.

In order to prevent toner on the intermediate transfer member from being cooled by the temperature of the printing medium, as shown in FIG. 3, the heater-incorporated preheating unit heats the printing medium, before transfer, to a temperature higher than the glass transition temperature of toner solids and lower than the melting point of toner solids.

Figure 4:
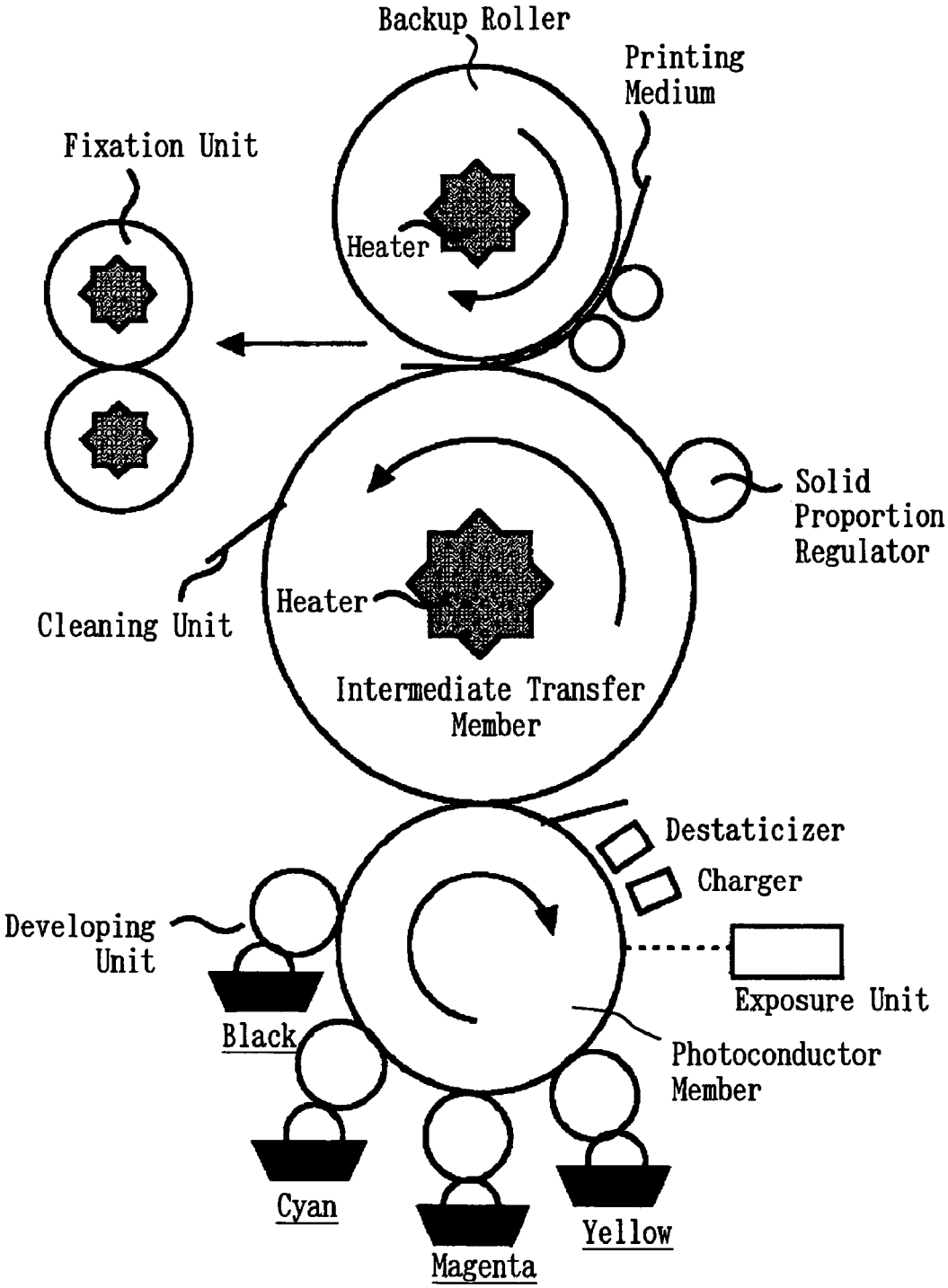
FIG. 4 is a view showing a third example of a full-color electrophotographic apparatus which embodies the present invention.

As shown in FIG. 4, the printing medium may be heated without provision of the preheating unit. Specifically, in a predetermined section of travel of the printing medium located upstream of a transfer position, the printing medium is brought in contact with the backup roller heated to a temperature higher than the glass transition temperature of toner solids and lower than the melting point of toner solids. This eliminates the need to provide the preheating unit, thereby implementing an inexpensive structure.

Figure 5:
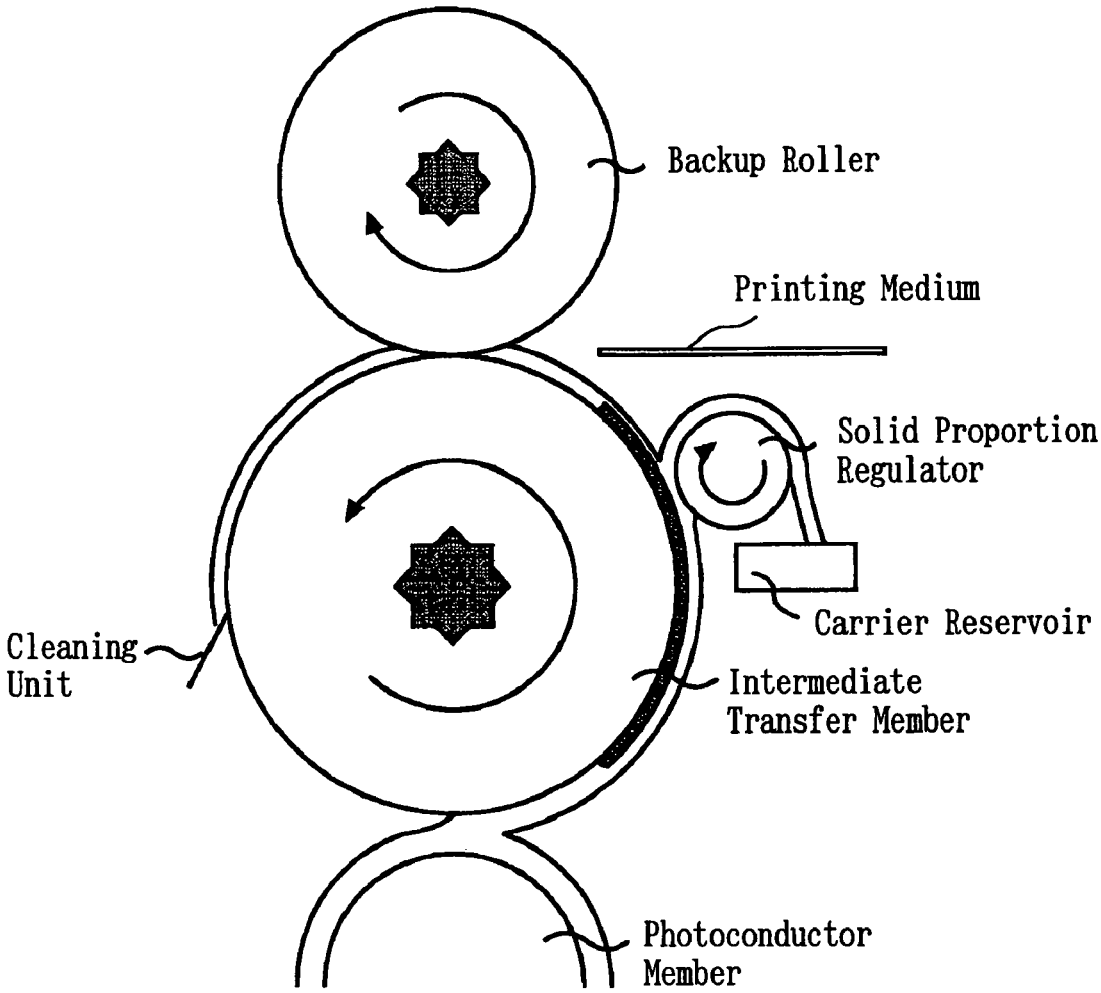
FIG. 5 is a view for explaining the operation of a solid proportion regulator.

By use of the solid proportion regulator as shown in FIG. 3, the toner solid proportion of a toner image formed on the intermediate transfer member is regulated to 50% to 90%. A toner image formed on the intermediate transfer member consists of toner solids and a carrier oil (carrier liquid). As shown in FIG. 5, the solid proportion regulator functions as follows: a roller of the solid proportion regulator is brought into contact with a carrier oil film of a toner image formed on the intermediate transfer member, and the carrier oil is transferred to the roller to thereby be removed. The quantity of carrier oil to be removed is regulated so as to increase the toner solid proportion of the toner image to 50% to 90%. The carrier liquid transferred to the roller is led to a carrier reservoir.

When the solid proportion is 90% or higher, solid adsorption to the intermediate transfer member occurs, and thus the efficiency of transfer to a printing medium drops. When the solid proportion is equal to or less than 50%, in a fixation process to be performed after transfer to the printing medium, residual carrier causes occurrence of a fixation defect, and the printing medium which has undergone fixation is in a wet condition (in a condition indicative of presence of residual carrier).

Thus, before a toner image on the intermediate transfer member is transferred to the printing medium, the toner solid proportion is regulated to 50% to 90% by means of the solid proportion regulator, whereby the toner image can be most efficiently transferred to the printing medium.

In a section of contact between the intermediate transfer member and the backup roller (transfer section), pressure is applied to a toner image in the above-mentioned condition so as to transfer the toner image to the printing medium. At this time, pressure to be applied is as slight as 1 MPa or less. This suppresses vibration that is generated when the printing medium is nipped in the transfer section, thereby preventing occurrence of image distortion called shock marks in a development process.

Figure 6:
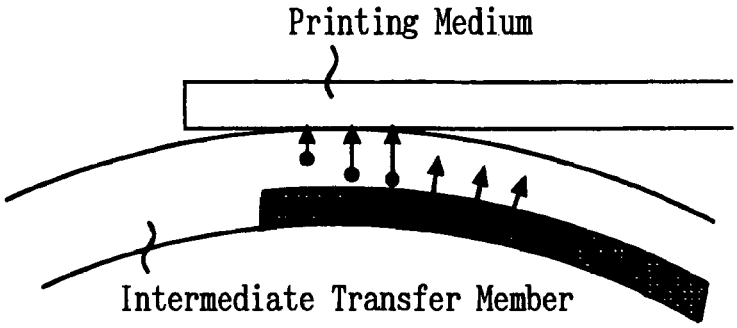
FIG. 6 is a view for explaining bias voltage application at the time of transfer to a printing medium.

When transfer of a toner image is performed in the section of contact between the intermediate transfer member and the backup roller, as shown in FIG. 6, a bias voltage ranging from 500 V to 5 kV is applied to the intermediate transfer member in the direction of transfer of toner to the printing medium. By so doing, the force of an electric field is exerted on toner solids in such a direction as to part the toner solids from the surface of the intermediate transfer member, thereby weakening adhesion of toner solids to the intermediate transfer member. Thus, toner can be transferred to the printing medium through application of a slight pressure of 1 MPa or less.

When the bias voltage is equal to or lower than 500 V, a drop in adhesion of toner to the intermediate transfer member is not sufficient. When the bias voltage is equal to or higher than 5 kV, micro discharge occurs in toner, thereby impairing transfer efficiency. Thus, a bias voltage ranging from 500 V to 5 kV is applied, thereby achieving most efficient transfer.

After transfer of a toner image to the printing medium, as shown in FIG. 3, the fixation unit—which is heated by means of the incorporated heaters to a temperature higher than the melting point of toner solids—applies a pressure of 0.5 MPa to 5 MPa to the printing medium, thereby fixing the transferred toner image.

The illustrated fixation unit is not drivingly linked to the image formation section including the intermediate transfer member, the photoconductor member, and the developing units. Thus, even though vibration is generated as a result of the printing medium being nipped in the fixation unit which applies firm pressure to the printing medium, the vibration does not influence a printing process, thereby causing no image distortion such as shock marks.

A fixation process performed by the fixation unit enhances toner cohesion to the printing medium which is insufficient at the time of transfer, thereby ensuring fixation strength. When the pressure to be applied in the fixation process is equal to or lower than 0.5 MPa, cohesion fails to be sufficiently enhanced. When the pressure is equal to or higher than 5 MPa, the pressure causes occurrence of image runs in the fixation section. Thus, a pressure ranging from 0.5 MPa to 5 MPa is applied, thereby achieving most efficient fixation.

Figure 7:
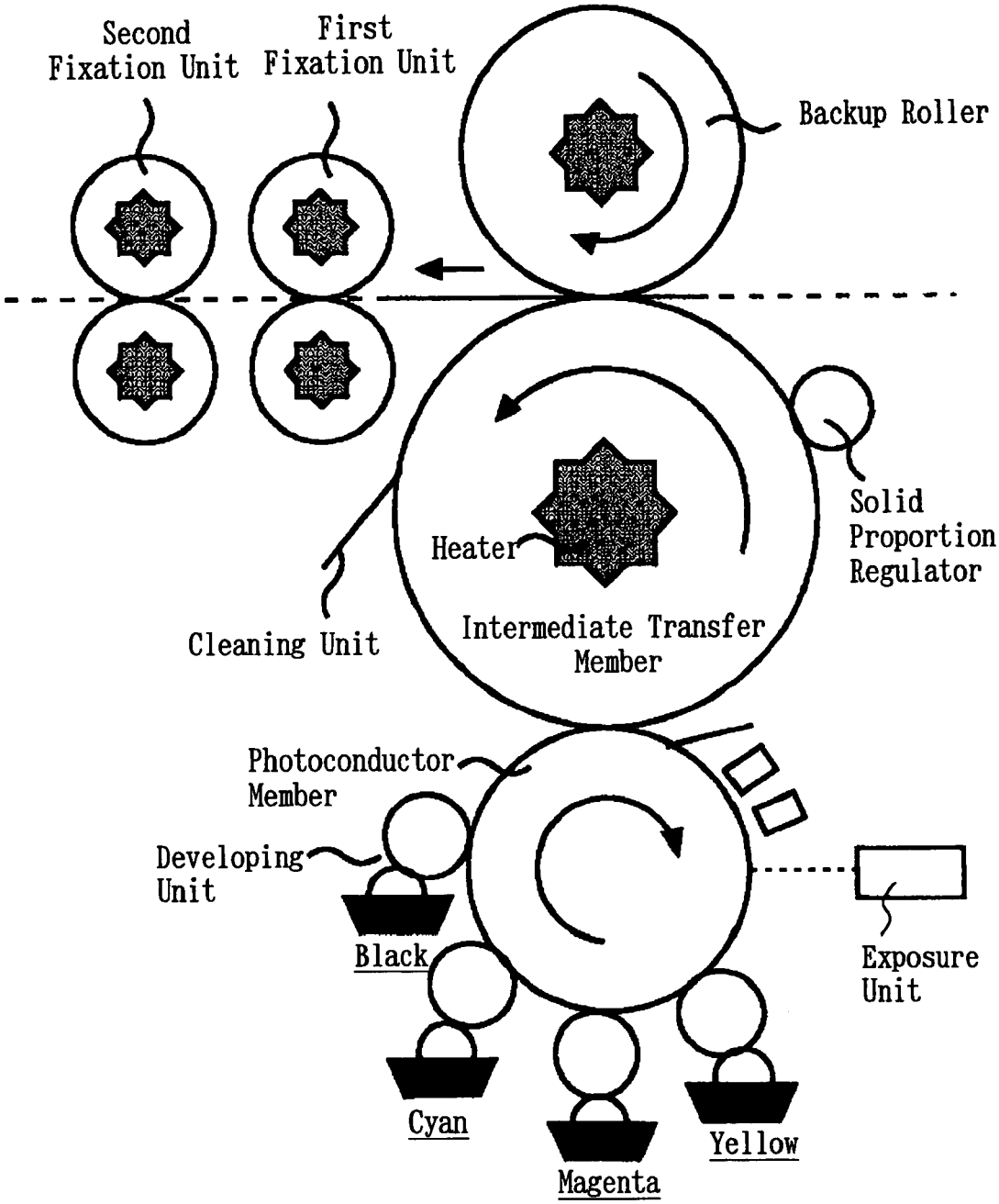
FIG. 7 is a view showing a configuration including a first fixation unit and a second fixation unit.

The fixation unit may be configured as shown in FIG. 7. Specifically, a first fixation unit—which is heated to a temperature higher than the glass transition temperature of toner solids and lower than the melting point of toner solids—applies a pressure of 0.5 MPa to 5 MPa. Subsequently, a second fixation unit—which is heated to a temperature higher than the melting point of toner solids—applies a pressure lower than that which the first fixation unit applies. In this manner, a toner image is fixed to the printing medium.

This allows the first fixation unit to apply a high pressure (0.5 MPa to 5 MPa) that tends to cause occurrence of offset, at a temperature at which molten toner itself exhibits strong cohesion (a temperature higher than the glass transfer temperature of toner solids and lower than the melting point of toner solids), whereby toner particles can be brought in a physically cohering condition while offset to the first fixation unit is prevented.

Furthermore, the second fixation unit applies a temperature at which toner is completely melted (a temperature higher than the melting point of toner solids), whereby sufficient fixation strength can be obtained. Since a physically cohering condition is established through application of high pressure in the first fixation unit, the second fixation unit—which completely melts toner particles—does not need to apply high pressure, thereby preventing occurrence of offset to the second fixation unit.

The illustrated electrophotographic apparatus transfers and fixes a toner image to a printing medium according to the above-described processes. Parameters used in the processes; i.e., pressure applied by means of the intermediate transfer member and the backup roller; toner solid proportion regulated by means of the solid proportion regulator; bias voltage applied to the intermediate transfer member at the time of transfer; pressure applied by means of the fixation unit; and temperature of the fixation unit, are variable within the aforementioned corresponding ranges so as to be optimized according to types of printing media.

For example, as shown in the table of FIG. 8, according to types of printing media; i.e., according to the thickness and surface roughness of printing media, information about optimum values of the parameters is stored in the present electrophotographic apparatus. According to a printing media to be used, corresponding parameter values are used so as to perform the transfer and fixation processes under the respectively optimum conditions.

Figure 9:
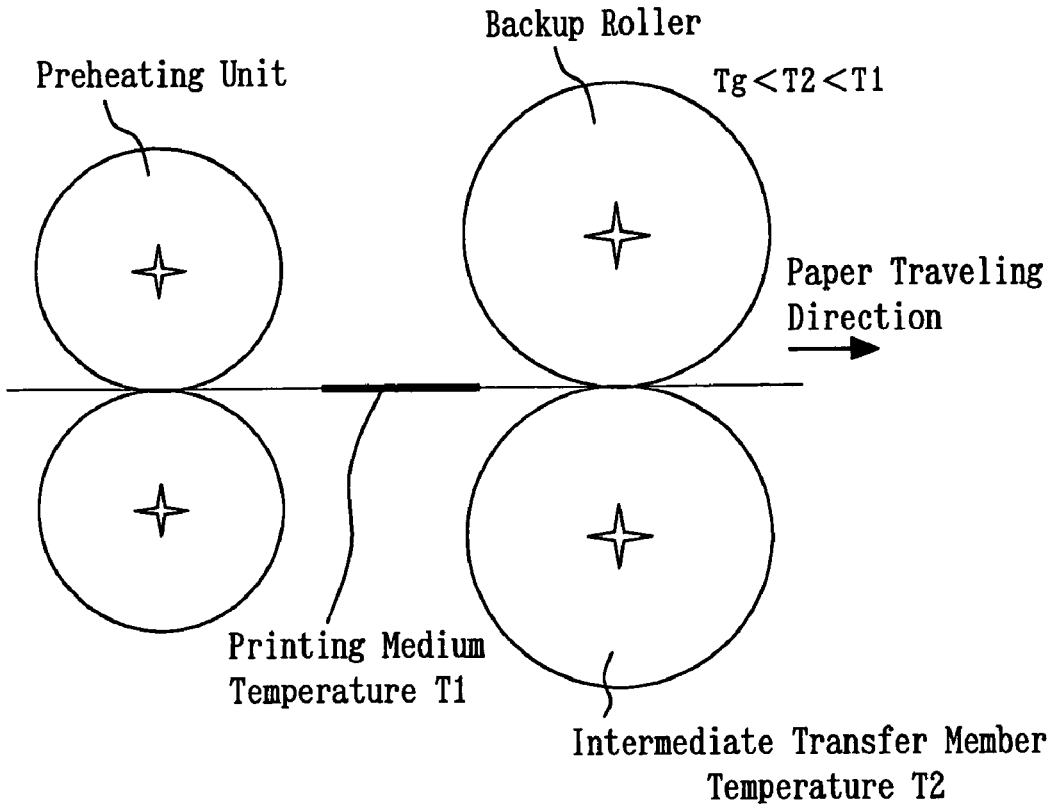
FIG. 9 is a view showing a preheating unit for preheating a printing medium and a transfer section.

Next, the temperature control of the full-color electrophotographic apparatus will be described with reference to FIGS. 9 to 14. FIG. 9 is a view showing a preheating unit for preheating a printing medium, and a transfer section. Tg represents the softening temperature of resin contained in a liquid toner to be used; Tm represents the melting temperature of resin; T1 represents the temperature of a printing medium; and T2 represents the temperature of the intermediate transfer member. Herein, the printing medium is preheated by means of the preheating unit; and the temperature T1 represents the temperature of the printing medium as measured in the transfer section.

First, temperature setting is performed such that the temperature T1 of the printing medium as measured in the transfer section is higher than the softening temperature Tg of resin and lower than the melting temperature Tm of resin ($Tg<T1<Tm$). Control is performed such that the temperature T2 of an image bearing member such as the intermediate transfer member is higher than the softening temperature Tg and lower than the temperature T1 of the printing medium as measured in the transfer section ($Tg<T2<T1<Tm$).

Through employment of the above temperature control, adhesion between the printing medium and toner in the transfer section can be enhanced, and adhesion between the intermediate transfer member and toner can be rendered weaker than the adhesion between the printing medium and toner. Thus, transfer efficiency can be improved without solely depending on the temperature of the intermediate transfer member. If the temperature setting $Tg<T1<T2$ is employed, adhesion between the intermediate transfer member and toner is maximized, resulting in a failure to improve the efficiency of transfer to the printing medium.

Figure 10:
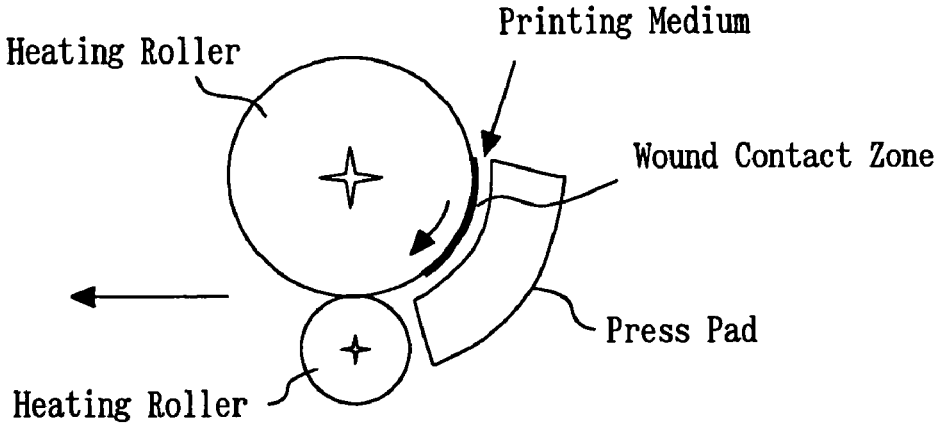
FIG. 10 is a view showing an example of the preheating unit.

As shown in FIG. 10, the preheating unit is configured such that a press pad, which serves as a press member, is disposed so as to cause the printing medium to be wound on one of paired heating rollers. At this time, the printing medium is fed such that its transferred-image side faces the press pad. Being wound on the heating roller, the printing medium can be sufficiently heated.

Force is applied to the printing medium (the printing medium is tensed) in such a manner as to be pressed against the heating roller, whereby the temperature of the printing medium can be controlled to a constant value (the upper-limit temperature is a set temperature of the preheating unit) irrespective of the type of printing medium.

Preferably, the press pad is formed of a metal of high thermal conductivity (aluminum or the like). The temperature of the press pad must be close to the temperature of the heating roller to the greatest possible extent so as to prevent a drop in temperature of the printing medium in a wound contact zone which would otherwise result from release of heat from the back side of the printing medium, and the temperature of the press pad must be held constant. These requirements are effectively met through use of the above metal.

Figure 11:
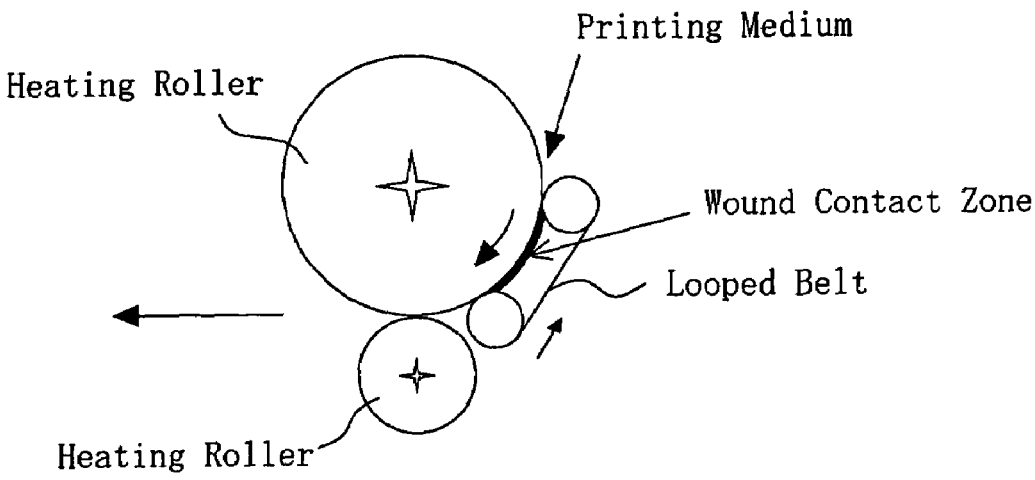
FIG. 11 is a view showing another example of the preheating unit, illustrating use of a flexible member as a press member.

FIG. 11 shows another example of the preheating unit, illustrating use of a flexible member as a press member. The preheating unit uses a belt looped around and extending between two rollers. A portion of the belt extending between the rollers abuts the heating roller. In this manner, through impartment of flexibility to the press member, the condition of close contact of the printing medium with the heating roller is enhanced, whereby the printing medium can be heated in a stabler condition.

Figure 12:
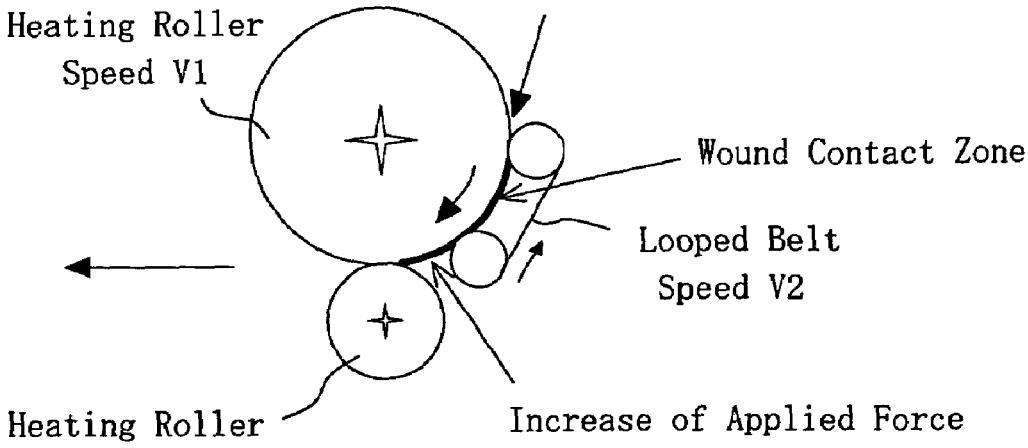
FIG. 12 is a view for explaining speed setting for the belt illustrated in FIG. 11.

FIG. 12 is a view for explaining speed setting for the belt illustrated in FIG. 11. When the press member is moved in the same direction as the moving direction of the heating roller (the surface of the press member and the surface of the heating roller move in the same direction), V1 represents the surface moving speed of the heating roller, and V2 represents the moving speed of the press member, V1 and V2 are selected in such a manner as to establish the relationship V2<V1, whereby the condition of close contact of the printing medium with the heating roller can be enhanced in the section between the exit of the wound contact zone and the nip zone of the paired heating rollers. As mentioned above, through rendering the speed of the heating roller higher than the speed of the looped belt, feed of the printing medium becomes excessive in the nip zone in relation to the wound contact zone, thereby establishing the condition of tensing the printing medium in the section between the exit of the wound contact zone and the nip zone of the rollers. Thus, the sag of the printing medium in the section can be prevented, thereby enhancing the condition of close contact of the printing medium with the heating roller and thus enabling stabler heating of the printing medium.

Figure 13:
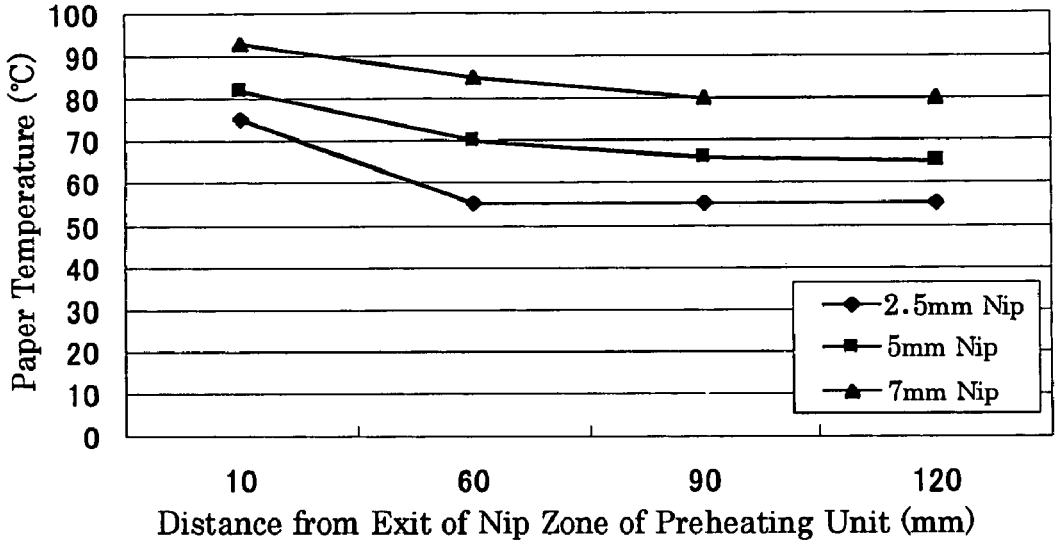
FIGS. 13(A) and 13(B) are a table and a graph, respectively, showing the results of measuring the temperature of paper in a melt transfer section while the length of a portion of paper in wound contact with a heating roller and the distance which paper travels until reaching the melt transfer section after leaving the paired rollers, are varied.
Figure 14:
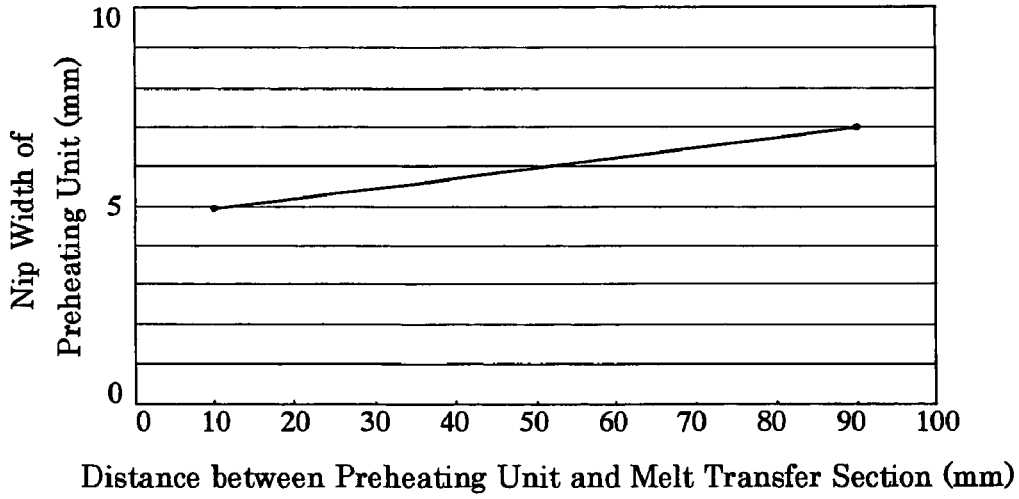
FIG. 14 is a graph showing the relationship between the nip width of the preheating unit and the distance from the preheating unit to the melt transfer section.

As described previously with reference to FIG. 10, the printing medium is heated through wound contact with one of the paired heating rollers and thus can be effectively heated. FIGS. 13 and 14 are a table and a graph showing the experimental results illustrating the effect of wound contact.

FIGS. 13(A) and 13(B) are a table and a graph, respectively, showing the results of measuring the temperature of paper in a melt transfer section while the length (nip width) of a portion of paper in wound contact with the heating roller and the distance which paper travels until reaching the melt transfer section after leaving the paired rollers (travel distance after passing the preheating unit), are varied. Wood free paper (225 kg/ream) was used as printing medium. When the softening temperature Tg of toner to be used is lower than 80° C., the paper temperature as measured in the melt transfer section must be 80° C. or higher as mentioned previously. As is apparent from FIG. 13, this requirement can be satisfied by employing a nip width of 7 mm or more or by disposing the preheating unit sufficiently near the melt transfer section (10 mm) even at a nip width of 5 mm.

FIG. 14 shows the relationship between the nip width of the preheating unit and the distance from the preheating unit to the melt transfer section in the case where, under the above-mentioned conditions, the temperature of the heating roller is set to 150° C., and a paper temperature of 80° C. or higher as measured in the melt transfer section is attained. The requirements of the present invention can be obtained from FIG. 14.

Figure 15:
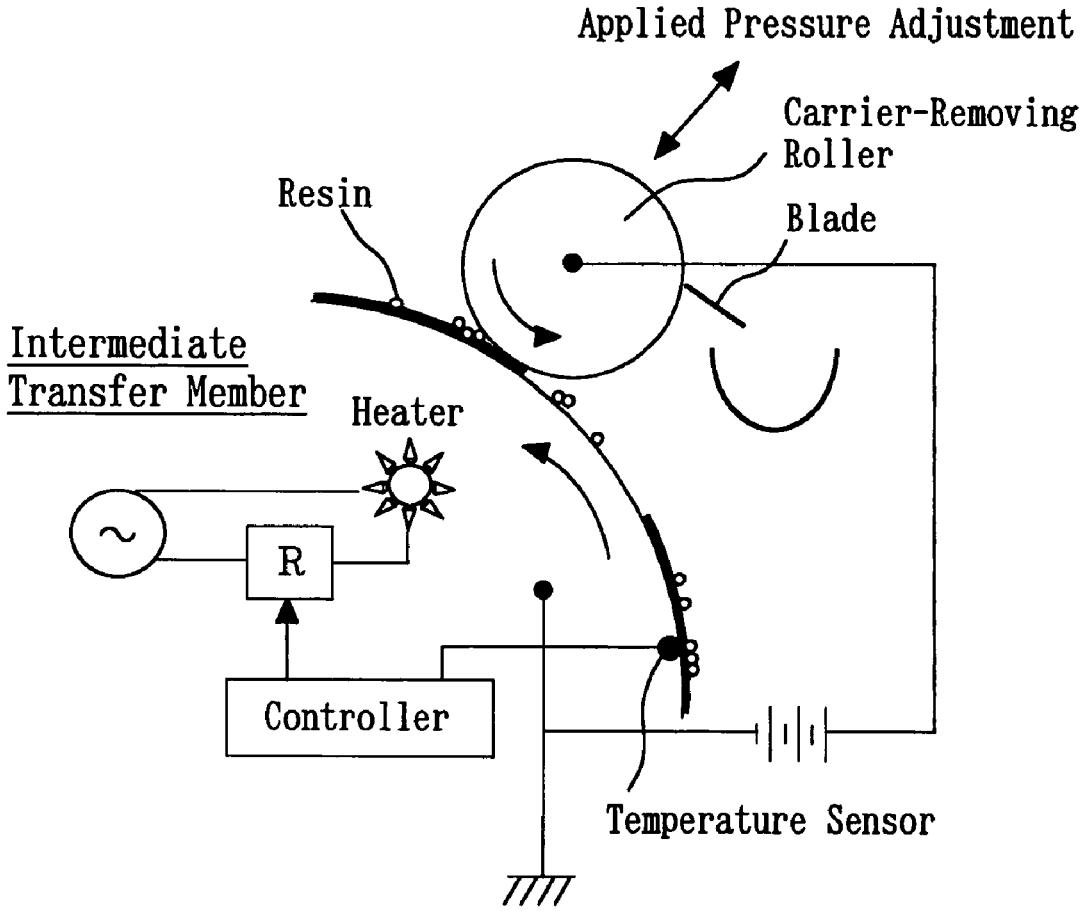
FIG. 15 is a view showing a carrier-removing roller on an intermediate transfer member as illustrated in FIG. 1.

Next, temperature control of the full-color electrophotographic apparatus will be described in terms of relation to resin used in a liquid toner (developer) with reference to FIG. 15. FIG. 15 is a view showing a carrier-removing roller on an intermediate transfer member as illustrated in FIG. 1 or 3. According to the illustrated configuration, excess carrier liquid on the intermediate transfer member is removed by use of the carrier-removing roller. However, the technique described herein is not limited to the intermediate transfer member, but can be applied to the case of transfer to a printing medium from an ordinary image bearing member including a photoconductor member.

As illustrated in FIG. 15, a carrier-removing unit includes the carrier-removing roller abutting the intermediate transfer member and adapted to effect re-cohesion while removing excess carrier liquid; and a bias voltage is applied to the carrier-removing roller. The carrier-removing roller is rotated in an opposite direction in relation to the intermediate transfer member, whereby a carrier can be removed at high rate. Herein, the term "opposite direction" means that contact surfaces of both rollers move in mutually opposite directions.

The carrier-removing roller employs, for example, a metal roller. A bias voltage of the same polarity as that of toner particles on the intermediate transfer member is applied to the metal roller, whereby, while a toner image is pressed against the intermediate transfer member, toner particles cohere. As a result, a purer carrier liquid is present in an outer surface portion of the toner layer and is removed through rotation of the carrier-removing roller. The carrier liquid removed by means of the carrier-removing roller is collected by means of a blade abutting the carrier-removing roller. A carrier-removing unit itself can be modified in various forms. For example, in place of the carrier-removing roller, a carrier-removing belt can be used.

The present invention uses a nonvolatile liquid toner formed such that toner particles consisting of resin and pigment are dispersed in silicone oil. A mixture of two types of resins of different softening temperatures is used as the resin. When Tg1 represents the softening temperature of one resin, Tg2 represents the softening temperature of the other resin, Tg3 represents the softening temperature of the mixed resin, and Tm3 represents the melting temperature of the mixed resin, The two types of resins are selected so as to establish the relation Tg1<Tg3<Tg2<Tm3. When T4 represents the temperature of the intermediate transfer member (image bearing member), and T5 represents the temperature of a printing medium at the time of transfer, the present invention controls the temperature of the intermediate transfer member and the temperature of the printing medium at the time of transfer so as to satisfy the relation Tg1<T4<Tg2<Tm3<T5. The temperature of the intermediate transfer member can be attained as follows: the temperature of the surface of the intermediate transfer member or the temperature of a near-surface portion of the intermediate transfer member is detected by means of a temperature sensor as shown in FIG. 15; the detected temperature serves as the above-mentioned temperature T4 of the intermediate transfer member; and current flowing to a heater is controlled such that the above-mentioned relation is satisfied. The temperature of the printing medium at the time of transfer can be attained as follows: a heater is provided in the backup roller (see FIG. 1 or FIG. 3); and the printing medium is heated by means of the backup roller. Alternatively, the temperature of the printing medium can be attained through preheating the printing medium before the printing medium is transferred to the transfer section. Alternatively, these two heating means can be used to attain the temperature of the printing medium. In any case, temperature control is performed through application of heat to the printing medium such that the printing medium temperature T5 at the time of transfer satisfies the above-mentioned relation.

When removal of carrier is performed while the temperature of the intermediate transfer member is set so as to fall between the softening temperatures of the two types of resins, the following effect is yielded: since one resin is heated to a temperature in excess of its softening temperature, the resin allows efficient removal of carrier; and since the other resin is heated to a temperature lower than its softening temperature, the resin functions to restrain adhesion to the intermediate transfer member. As a result, while removal of carrier is sufficiently performed (a solid proportion equal to or higher than 50%–90%), adhesion to the intermediate transfer member can be rendered weak. Furthermore, the medium temperature is set higher than the melting temperature of the mixed-resin toner, thereby generating stronger adhesion for transfer. At this time, since adhesion to the intermediate transfer member is weak, transfer can be performed at good transfer efficiency.

Preferably, the mixed-resin toner is prepared so as to establish the relation (T4–Tg1)<20° C. and the relation (Tg2–T4)>10° C. In the case of (T4–Tg1)<20° C., adhesion developed by the resin of Tg1 is not excessively strong, and the resin of Tg2 restrains adhesion to the intermediate transfer member, whereby good transfer efficiency is exhibited. By contrast, in the case of (T4–Tg1)≧20° C., since the resin of Tg1 is excessively melted, adhesion to the intermediate transfer member becomes locally strong. As a result, the resin of Tg2 fails to sufficiently restrain adhesion to the intermediate transfer member, leading to occurrence of transfer dropout.

In the case of (Tg2–T4)>10° C., the resin of Tg2 restrains adhesion of the resin of Tg1 to the intermediate transfer member, whereby good transfer efficiency is exhibited. By contrast, in the case of (Tg2–T4)≦10° C., the capability of the resin of Tg2 of restraining adhesion is weak. As a result, adhesion to the intermediate transfer member increases, leading to occurrence of transfer dropout.

Preferably, in the mixed-resin toner to be used, the two resins are mixed such that the proportion of the resin of Tg1 is 20% to 80%. When the mixing proportion of the resin of Tg1 is 20% to 80%, the carrier removal efficiency is good, and adhesion of the resin of Tg1 can be restrained by means of the resin of Tg2, whereby transfer is performed in a good condition. When the mixing proportion of the resin of Tg1 is 20% or less, the resin of Tg2 whose temperature is lower than its softening temperature increases in proportion, whereby the carrier removal efficiency is impaired with resultant occurrence of fixation defect. By contrast, when the mixing proportion of the resin of Tg1 is 80% or higher, adhesion to the intermediate transfer member cannot be restrained by means of the resin of Tg2, resulting in occurrence of transfer defect.

FIG. 16 shows the softening temperatures (Tg1 and Tg2) of resins contained in each of toners (toners A to E), the mixing proportions of the resins, and the softening temperature (Tg3) and the melting temperature (Tm3) of each toner serving as a mixed-resin toner. Toner A contains a single type of resin. Notably, the resin, pigment, and the other aid total 100%. A resin contained in each of toners A to E is bisphenol A epoxy resin. Resin samples of different softening temperatures were prepared through varying the degree of polymerization. Notably, polyester resin is known to change its softening temperature according to molecular weight. Resin to be used in the present invention is not limited to epoxy resin so long as resin to be used can vary its softening temperature.

FIG. 17 shows the results of studying the transfer efficiency of transfer from an intermediate transfer member to a printing medium by use of the toners of FIG. 16 while the intermediate transfer member temperature T4 and a carrier removal count are varied. The results of evaluation of transfer efficiency are represented as follows: excellent ○; good Δ; poor X; and worst XX. Generally speaking, the more a carrier is removed, the more likely the transfer efficiency worsens. However, as mentioned previously, insufficient removal of a carrier liquid may affect melting of a toner layer at the time of fixation and may cause disturbance of image due to generation of a streaky pattern called riblet (ribs).

In the case of using toner A which contains a single type of resin, conditions which bring about good transfer efficiency are present, but an increase in carrier removal count (an increase in solid proportion as measured before transfer) tends to worsen transfer efficiency. Also, toner A is sensitive to temperature conditions, for the following reason. In the case of toner which contains only a single type of resin, the entire toner assumes a softened condition or a molten condition according to temperature. Thus, adhesion to the intermediate transfer member increases, thereby narrowing the range of conditions under which good transfer efficiency is exhibited.

By contrast, toners B to E, each of which contains two types of resins, show a wide range of intermediate transfer member temperature and carrier removal count conditions under which good transfer efficiency is exhibited. This is conceivably for the following reason. The intermediate transfer member temperature T4 is set in relation to the softening temperatures Tg1 and Tg2 of the two types of resins in such a manner as to satisfy the relation Tg1<T4<Tg2. By so doing, the resin whose temperature is lower than its softening temperature plays a role for restricting adhesion to the intermediate transfer member, thereby expanding the range of temperature and carrier removal count in which good transfer efficiency is exhibited.

The experimental results of transfer efficiency as measured by use of the toners of different resin mixing proportions indicate the following.

Even when the condition Tg1<T4<Tg2 is established, if Tg1 is excessively lower than T4, a molten condition excessively proceeds, thereby locally impairing transfer efficiency.

When Tg2 is too close to T4, the force of restricting melting becomes weak, resulting in impaired transfer efficiency. The above experimental results reveal the following. Good transfer efficiency is exhibited under the conditions of (T4–Tg1)<20° C. and (Tg2–T4)>10° C. If (Tg2–T4) is too large, melting hardly proceeds, resulting in impaired transfer efficiency. Thus, the condition 30° C.>(Tg2–T4)>10° C. is preferred.

In the present experiment, the medium temperature T5 is set in such a manner as to satisfy the relation Tg3<T5. However, since, as a molten condition proceeds at the time of transfer to the medium, transfer efficiency improves, the condition Tm3<T5 is preferred.

Next, a fixation process will be described. In the fixation process, toner must be fixed to a printing medium without involvement of high-temperature offset. As mentioned previously, a liquid toner to be used is prepared as follows. Thermoplastic resin, pigment, and additive are mixed; the resultant mixture is formed into powder of a particle size of about 1 μm; and the powder, together with dispersant, is dispersed in a nonvolatile carrier liquid.

Figure 18:
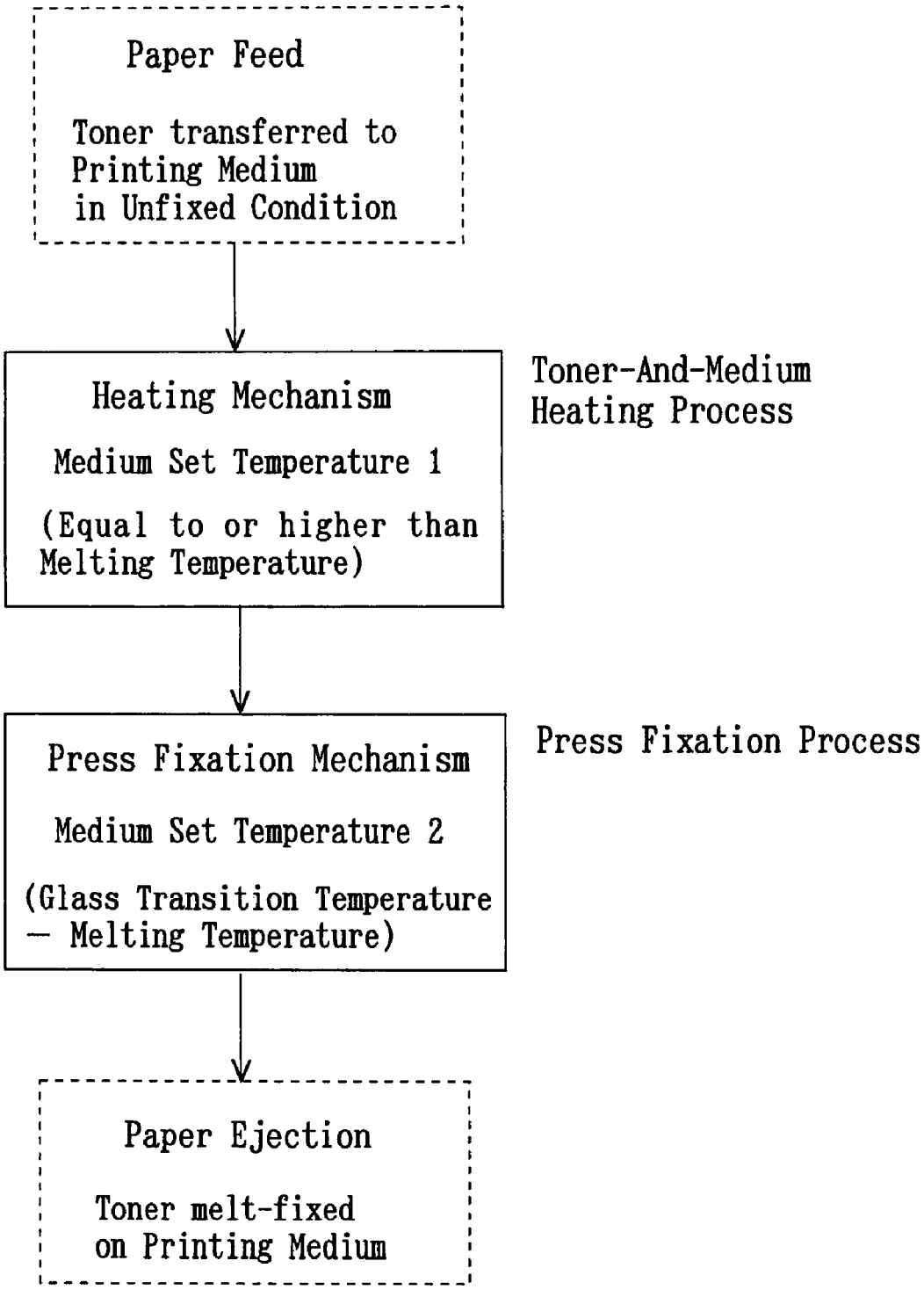
FIG. 18 is a view functionally representing a fixation unit.

FIG. 18 is a view functionally representing a fixation unit. The functional process of the fixation unit of an electrophotographic apparatus using a liquid toner consists of the following two stages of independent processes: a toner-and-printing-medium heating process which a heating mechanism carries out, and a press fixation process which a press fixation mechanism including press fixation rollers carries out.

In the toner-and-printing-medium heating process, the heating mechanism heats the printing medium to which toner has been transferred but which has not undergone fixing, to a temperature (100° C. to 200° C.) equal to or higher than the melting temperature of the resin component of toner particles, thereby melting the resin component of toner particles. In the press fixation process, the press fixation mechanism causes the printing medium to pass through a fixation nip zone where a pressure of 0.2 Mpa to 5 Mpa (2 Kgf/cm$^2$ to 50 Kgf/cm$^2$) is applied to the resin component of toner particles molten on the printing medium, and at least the toner image side of the printing medium is heat-retained at a temperature (50° C. to 150° C.) equal to or higher than the glass transition temperature (Tg) of toner and equal to or lower than the melting temperature (Tm) of toner, thereby fixing the toner.

According to the above configuration, in the toner-and-printing-medium heating process, toner and the printing medium are heated to a temperature equal to or higher than the melting temperature (Tm) of resin, which is a solid component of toner, thereby liquefying the resin. However, in this state, the toner resin surrounded by dispersant does not come into close contact with the printing medium.

A color liquid toner can yield high transparency and adhesion when the toner is brought in close contact with a printing medium at a temperature equal to or higher than the melting temperature (Tm) at which strong adhesion is developed. However, in the range of from the glass transition temperature (Tg) to the melting temperature (Tm), adhesion drops, and fluidity is low; thus, obtainment of transparency is difficult. Furthermore, a toner resin which is heated to a temperature equal to or higher than the melting temperature (Tm) and is present at a thickness of several μm is very hard to adhere to an object whose temperature is equal to or lower than the melting temperature (Tm).

The toner and the printing medium which have been heated in the toner-and-printing-medium heating process promptly enters the press fixation process. At this time, the printing medium temperature and the toner temperature are higher than the temperature of the press fixation rollers.

However, in the fixation nip zone which the press fixation rollers form, the temperature of the toner layer surface facing the press fixation roller promptly becomes equal to or higher than the glass transition temperature (Tg) of toner and equal to or lower than the melting temperature (Tm) of toner. Being greater in thermal capacity than the toner layer, the printing medium itself exhibits a gradual drop in temperature. Thus, the toner layer surface facing the printing medium maintains a temperature equal to or higher than the melting temperature (Tm) for a while. During this period of time, pressure applied by the press fixation rollers and shear stress or the like generated in the fixation nip zone squeeze molten toner resin out of dispersant, thereby enabling the molten toner resin to be press-fixed to the printing medium which maintains a temperature equal to or higher than the melting temperature (Tm).

Meanwhile, since the molten toner resin which comes into contact with the press fixation roller is instantaneously cooled to a temperature falling within the range of from the glass transition temperature (Tg) of toner to the melting temperature (Tm) of toner, the molten toner resin does not make high-temperature offset to the press fixation roller.

Figure 19:
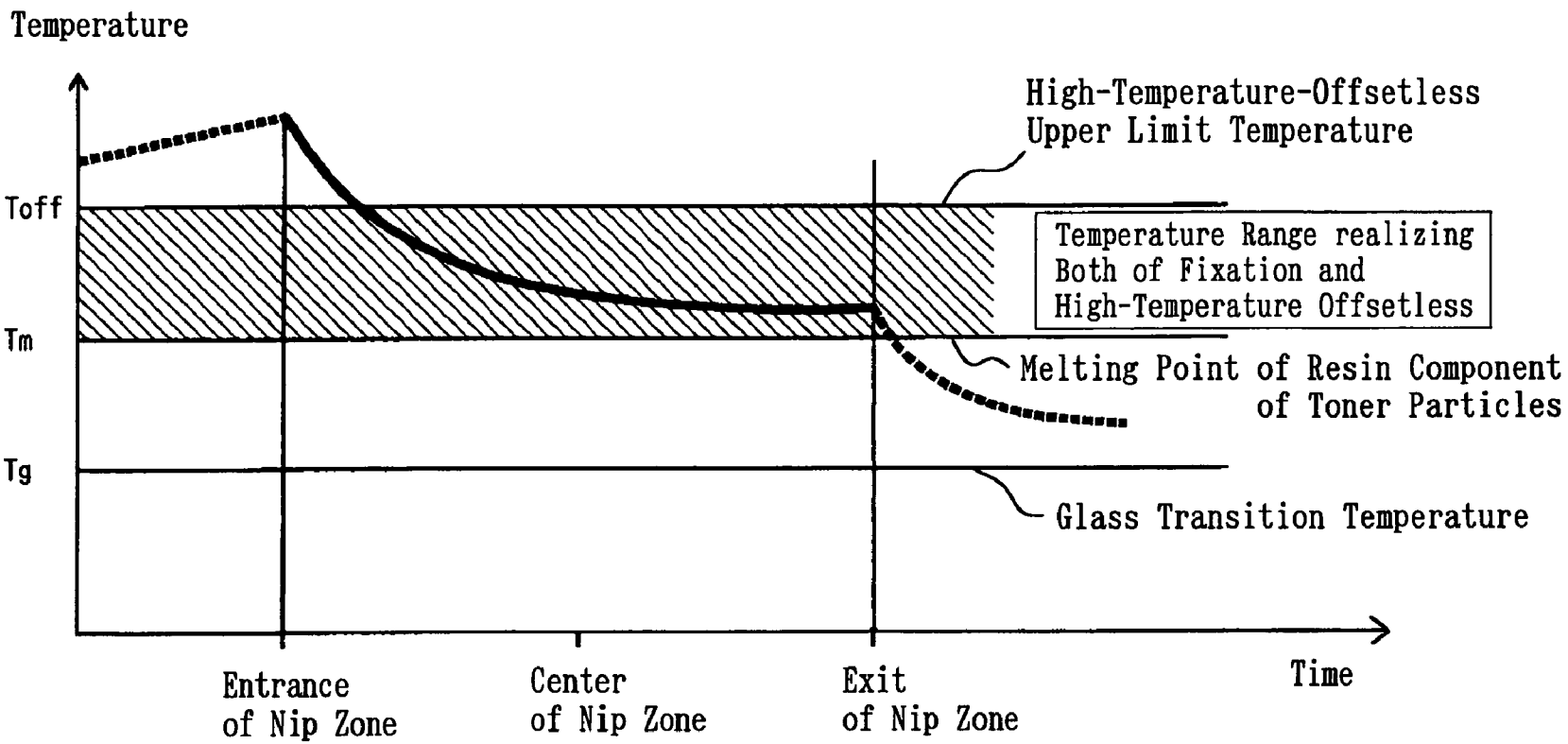
FIG. 19 is a diagram illustrating a toner surface temperature history as observed in a fixation nip zone.

FIG. 19 is a diagram illustrating a toner surface temperature history as observed in the fixation nip zone. As illustrated in FIG. 19, in the toner-and-printing-medium heating process which the heating mechanism carries out, toner and the printing medium are preheated to a temperature equal to or higher than the melting temperature of the resin component of toner particles (to a temperature equal to or higher than the high-temperature-offsetless upper limit temperature Toff). (According to the illustration in FIG. 19, a temperature at the entrance of the nip zone is in excess of the high-temperature-offsetless upper limit temperature Toff.)

Next, in the press fixation process which the press fixation mechanism carries out, the toner surface temperature is held equal to or lower than the upper limit temperature Toff at or below which high-temperature offset does not occur, as measured before the exit of the fixation nip zone formed by the press fixation rollers is reached. Notably, the high-temperature-offsetless upper limit temperature is the maximum temperature at which fixation and the high-temperature offsetless condition are both realized. So long as the toner temperature as measured immediately after the exit of the press fixation rollers is equal to or lower than the upper limit temperature Toff, high-temperature offset to the press fixation roller does not occur.

Figure 20:
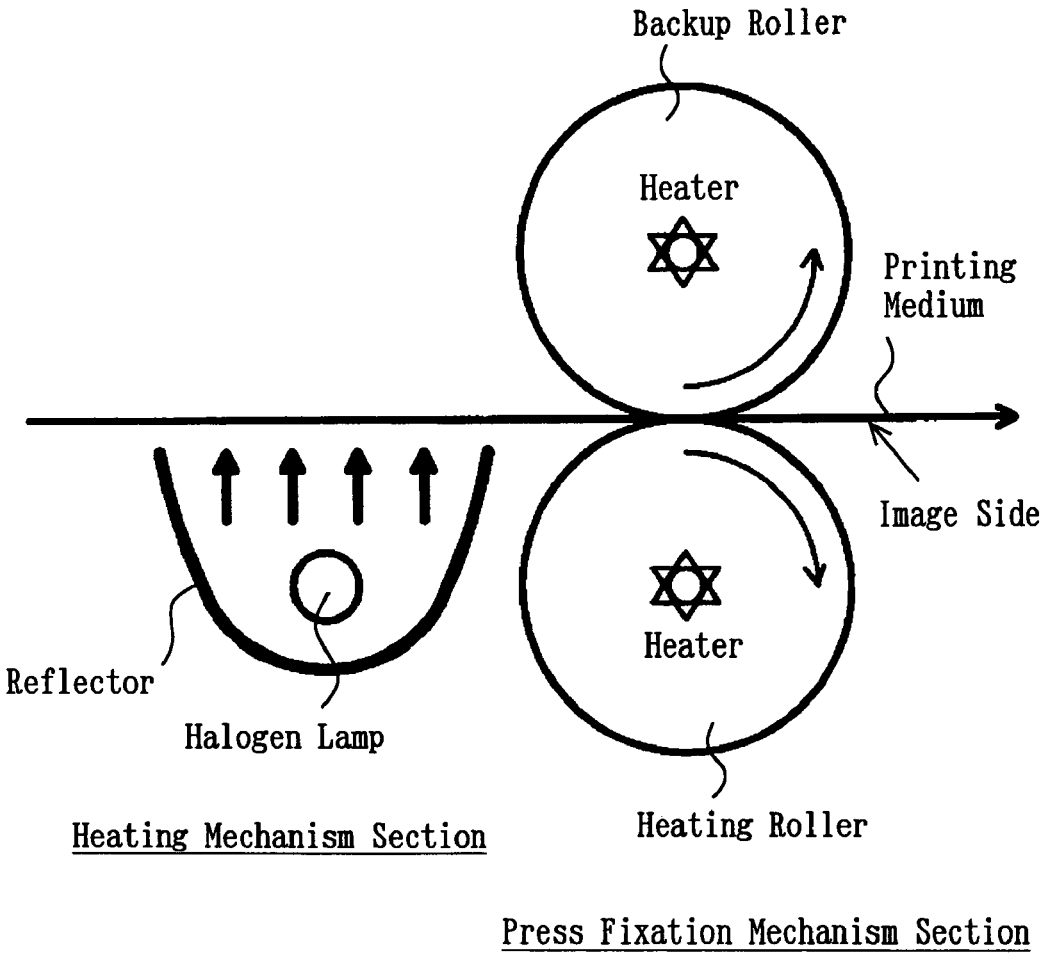
FIG. 20 is a view showing a first example of a fixation unit configuration including a heating mechanism and a press fixation mechanism.

Next, further description will be provided with reference to FIG. 20 showing a first example of a fixation unit configuration including a heating mechanism and a press fixation mechanism. As illustrated in FIG. 20, the heating mechanism includes one or more mechanisms for heating toner and printing medium in a noncontact condition by means of radiant heat generated by a halogen lamp heater including a reflector and a halogen lamp. Alternatively, the heating mechanism may include one or more mechanisms for heating toner and printing medium in a noncontact condition by means of radiant heat generated by a far-infrared heater.

In the case where, before entering the press fixation process, a toner image transferred to a printing medium is preheated through contact heat transmission from a high-temperature heating member, a problem of high-temperature offset is confronted as in the case of a conventional heating-roller fixation process. However, the above-described configuration which employs noncontact heating by use of a radiant heat source does not involve the problem associated with contact heat transmission. Use of a halogen lamp of a far-infrared wavelength range as a radiant heat source allows heating of the toner side of the printing medium through far-infrared wavelength radiation without being influenced by toner colors, which are visible-light components.

The press fixation mechanism includes a heater-incorporated heating roller and a heater-incorporated backup roller. The heating roller is set to a temperature of 50° C. to 150° C. (a temperature equal to or higher than the glass transition temperature of toner and equal to and lower than the melting temperature of toner) and is retained at the temperature. The heating roller is adapted to fix a toner image in a section of contact with the printing medium while the toner image is passing through a fixation nip zone. The backup roller is set to a temperature of, for example, 50° C. to 150° C. (a temperature equal to or higher than the glass transition temperature of toner and equal to and lower than the melting temperature of toner) and is retained at the temperature. The backup roller is adapted to exert a pressure of 0.2 MPa to 5 MPa (2 $Kgf/cm^2$ to 50 $Kgf/cm^2$) in the fixation nip zone.

Preferably, the surface of the heating roller is covered with a rubber material of low thermal conductivity and good parting performance, such as silicone rubber or fluorine-containing rubber.

Figure 24:
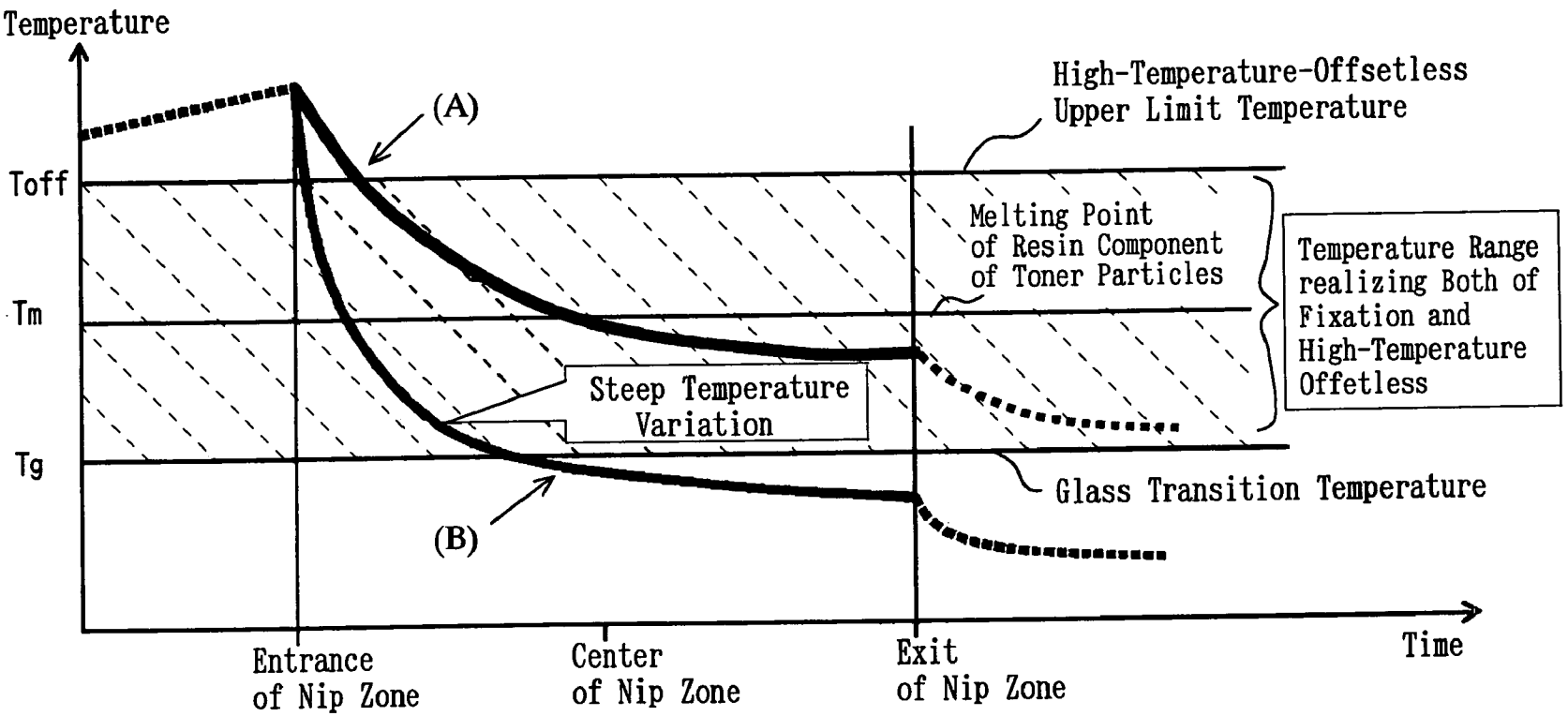
FIG. 24 is a diagram illustrating a printing medium surface temperature history as observed in the fixation nip zone.

FIG. 24 is a diagram illustrating a printing medium surface temperature history as observed in the fixation nip zone. As represented by the curve (A) in FIG. 24, through covering the heating roller surface with a rubber material of low thermal conductivity, heat transmission from the high-temperature printing medium to the heating roller material becomes gentle such that temperature gently drops until the center of the nip zone where a peak pressure arises is reached.

For comparison, FIG. 24 shows the curve (B) representing the case where the heating roller member is configured such that a fluorine-containing resin coat is applied to the surface of an aluminum pipe at a thickness of tens of $\mu$m. Since the thermal conductivity of the heating roller is considerably high as compared with the thermal conductivity of toner and printing medium, the toner image temperature steeply drops at the entrance of the fixation nip zone. As a result, fixation strength becomes unlikely to increase.

The heating roller temperature is set equal to or higher than the glass transition temperature (Tg) of the resin component of toner particles and equal to or lower than the melting temperature (Tm) of the resin component of toner particles. This setting is intended to gently lower the fixation nip zone temperature as observed in a fixation nip zone temperature history. Most preferably, in order to prevent high-temperature offset, the printing medium surface temperature at the exit of the fixation nip zone is equal to or higher than the glass transition temperature (Tg) of the resin component of toner particles and equal to or lower than the melting temperature (Tm) of the resin component of toner particles.

The above-mentioned conditions are summarized as follows:

1. When the condition "heating roller temperature≦glass transition temperature of the resin component of toner particles" is established, the fixation nip zone temperature steeply drops; consequently, fixation strength fails to increase.

2. Establishment of the condition "glass transition temperature of the resin component of toner particles≦heating roller temperature≦melting temperature of the resin component of toner particles" is preferred in terms of fixation strength and prevention of high-temperature offset.

3. When the condition "melting temperature of a resin content of toner particles≦heating roller temperature" is established, the toner and printing medium surface temperature does not sufficiently drop before the exit of the fixation nip zone is reached; consequently, high-temperature offset is prone to occur.

As is apparent from the above description, it is effective to perform temperature control of the heating roller according to thermal characteristics of the resin component of toner particles.

Figure 21:
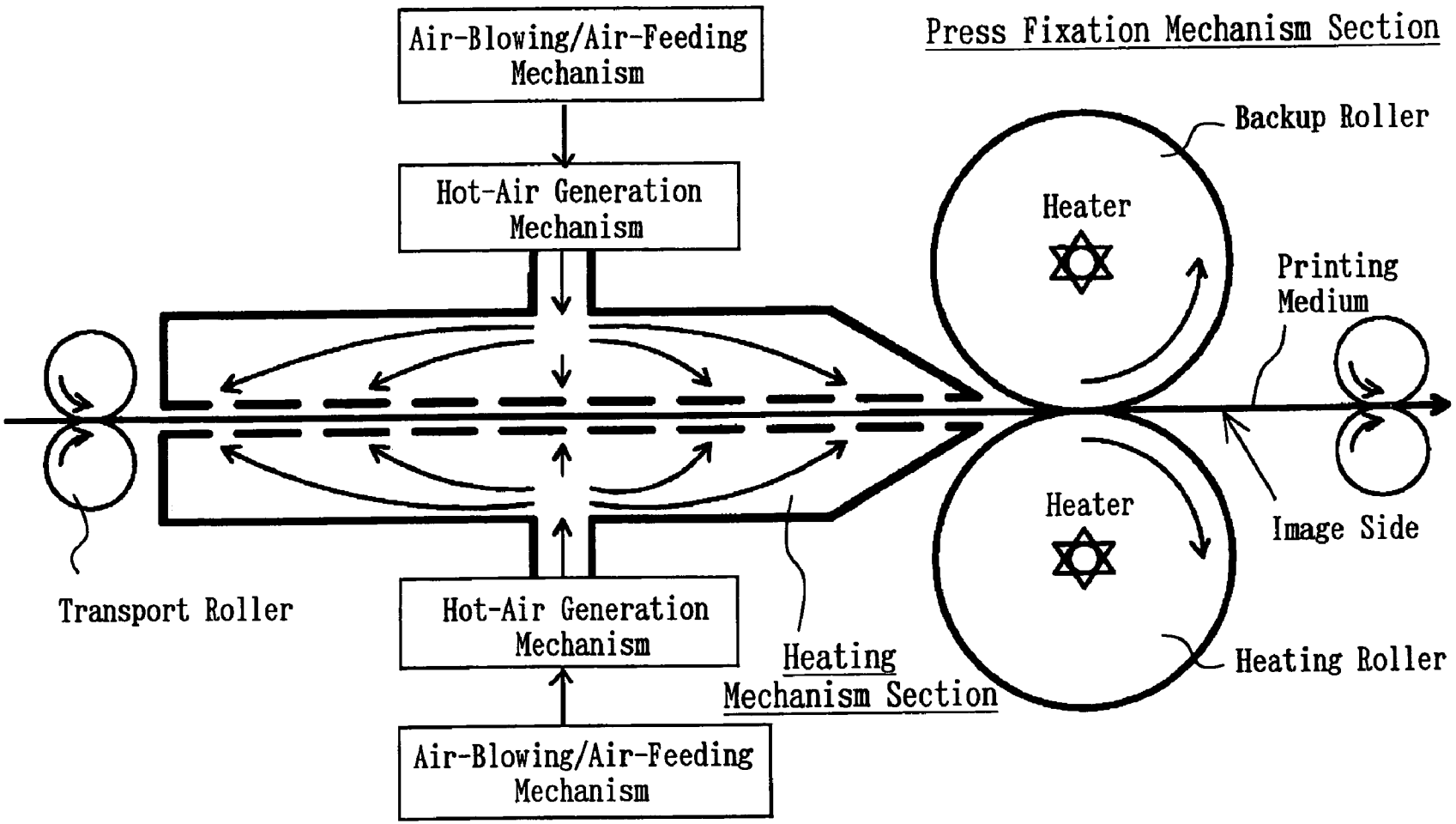
FIG. 21 is a general view showing a second example of the fixation unit configuration.
Figure 22:
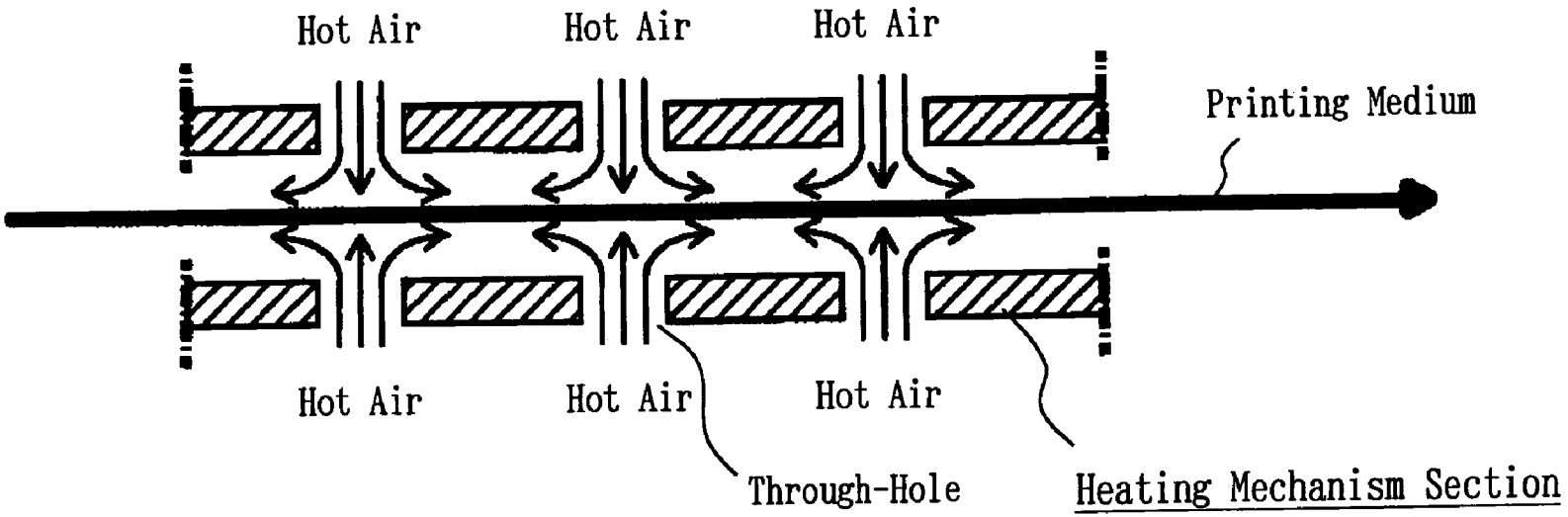
FIG. 22 is an enlarged view showing a portion in the vicinity of a printing medium of the configuration illustrated in FIG. 21.

FIGS. 21 and 22 are views illustrating a second example of the fixation unit configuration, wherein FIG. 21 is a general view, and FIG. 22 is an enlarged view showing a portion of the configuration in the vicinity of a printing medium. As shown in FIG. 21, a heating mechanism section is equipped with an air-blowing/air-feeding mechanism and a hot-air generation mechanism. Upper and lower heating mechanism sections are provided in a vertically symmetrical condition so as to discharge hot air from opposite sides (from above and below in FIGS. 21 and 22) of a printing medium transport path. An opening portion is formed on each of the upper and lower heating mechanism sections in order to introduce hot air into the heating mechanism section from the corresponding hot-air generation mechanism. Each of the upper and lower heating mechanism sections is formed into the shape of a chamber such that its five faces are closed, and the remaining one face has a number of fine through-holes formed therein (see FIG. 22). When hot air is led into the chamber, hot air is uniformly discharged through the face having fine through-holes formed therein. Each of the air-pump-incorporated air-blowing/air-feeding mechanisms sends air to a heater heated to high temperature of the corresponding hot-air generation mechanism, whereby hot air is generated and supplied to the corresponding heating mechanism section.

The upper and lower heating mechanism sections are disposed such that the respective fine-hole-formed faces having a number of fine through-holes formed therein face each other with a gap of 1 mm to 20 mm formed therebetween; and hot air is fed into the heating mechanism sections from the corresponding hot-air generation mechanisms. A printing medium in an unfixed condition is transported from transport rollers and is caused to pass through hot air discharged from the through-holes arranged in a facing condition. Then, the printing medium is transported to the press fixation mechanism consisting of a heating roller and a backup roller. In this case, as shown in FIG. 22, the printing medium to which toner adheres can be heated while being levitated from the opposite heating mechanism sections. Notably, the heating mechanism section may be configured such that hot air is discharged upward from under the printing medium to which toner adheres, so as to heat the printing medium while causing the printing medium to levitate.

Figure 23:
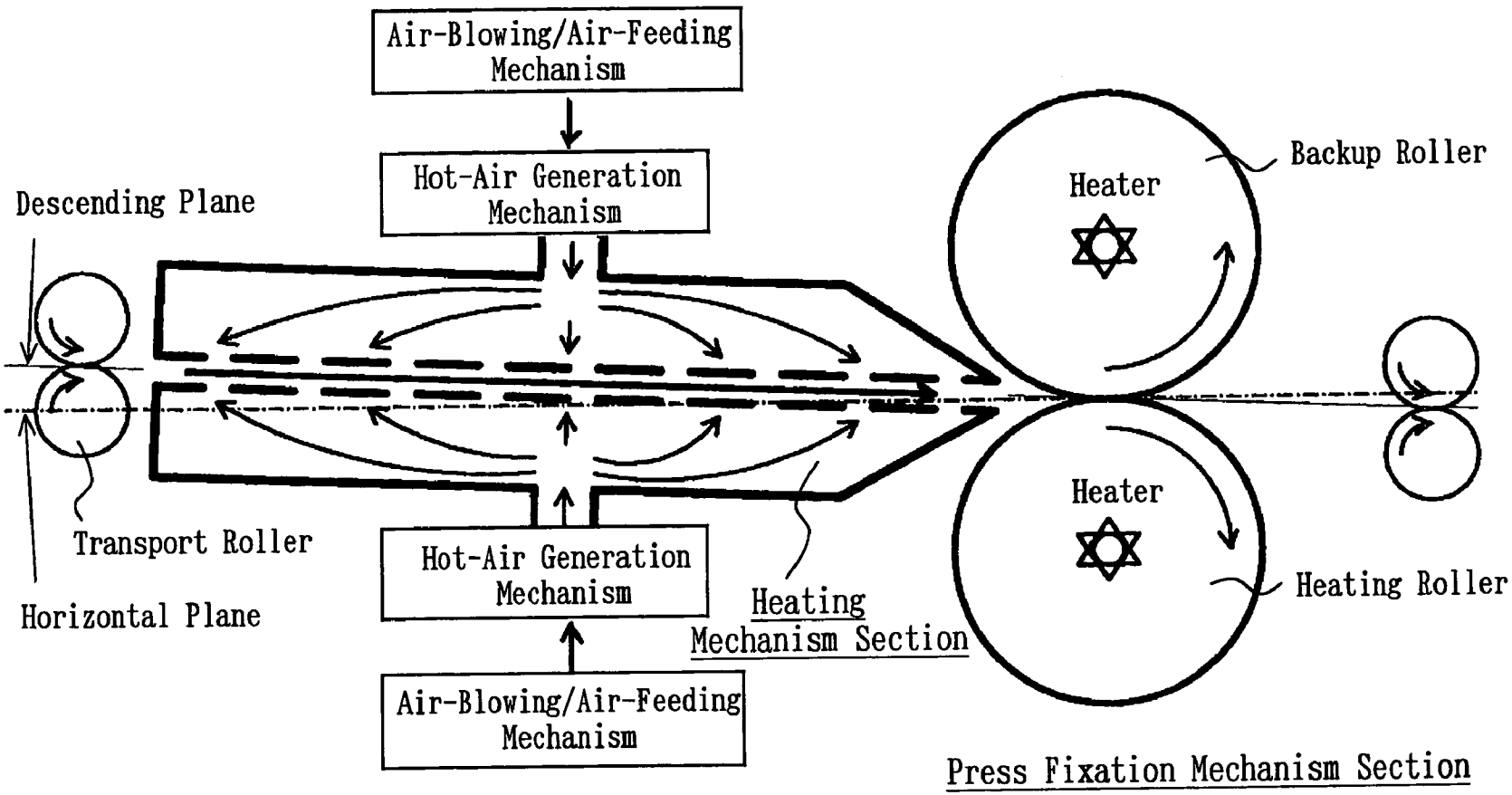
FIG. 23 is a view showing a third example of the fixation unit configuration.

FIG. 23 is a view showing a third example of the fixation unit configuration. As shown in FIG. 23, the fixation unit is configured such that the fine-hole-formed faces of the corresponding chamber-like heating mechanism sections descend with respect to a horizontal plane and the traveling direction of the printing medium. Also, the fixation unit is configured such that, even when the printing medium length is shorter than the length of the heating mechanism section as measured along the traveling direction of the printing medium, the printing medium slides down under its own weight to the exit of the heating mechanism sections while levitating from the fine-hole-formed faces of the corresponding heating mechanism sections.

According to the above-described configuration, the heating mechanism sections descend with respect to a horizontal plane and the traveling direction of the printing medium. Thus, even when the printing medium is shorter than the length of the heating mechanism section, the printing medium which has left the transport rollers adapted to transport the printing medium slides down under its own weight while levitating from the fine-hole-formed faces. At this time, the printing medium enters the fixation nip zone of the heating roller heated to a temperature equal to or higher than the melting temperature of toner. Then, the printing medium undergoes press fixation effected by the heating roller whose temperature is set equal to or higher than the glass transition temperature of toner and equal to and lower than the melting temperature of toner without involvement of high-temperature offset, followed by ejection.

Figure 25:
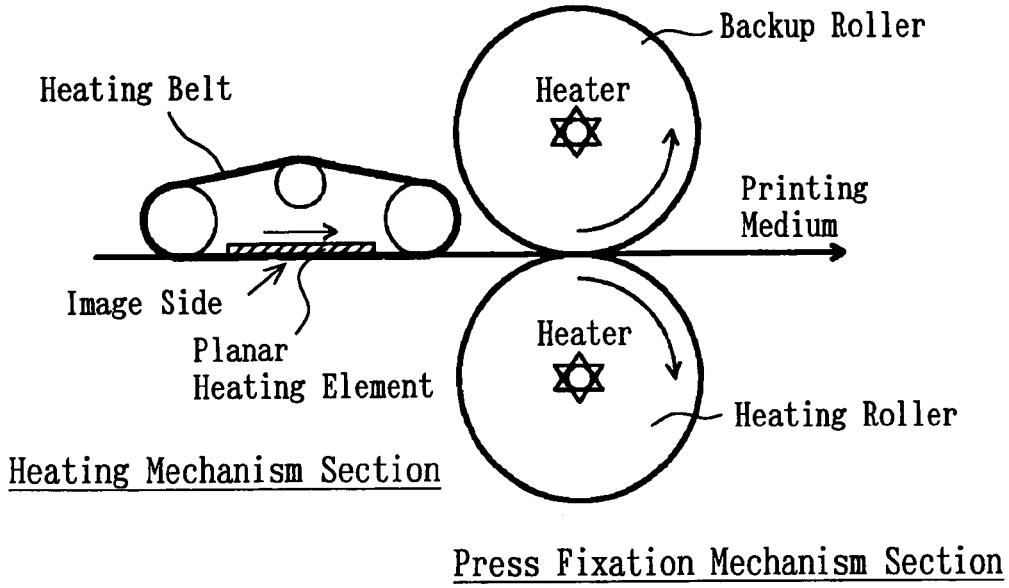
FIG. 25 is a view showing a fourth example of the fixation unit configuration.

FIG. 25 is a view showing a fourth example of the fixation unit configuration. As shown in FIG. 25, the heating mechanism section includes a heating belt in contact with a planar heating element. The temperature of the heating belt to be heated by the planar heating element is set so as to heat the printing member to a temperature (100° C. to 200° C.) equal to or higher than the melting point of the resin component of toner particles. The heating belt heats the printing medium from the back side opposite the toner image side, thereby increasing the temperature of the toner image side. Preferably, the heating belt is formed of electrically insulative polyimide, and the heating belt surface is electrostatically charged so as to transport the printing medium by means of electrostatic adsorption.

According to the above-described configuration, a toner image on the printing medium can be heated in a noncontact condition. Since the printing medium is heated from its back side for sufficient time until its temperature becomes substantially equal to the temperature of the heating belt, substantially constant preheating can be performed on the printing medium, irrespective of the type and thickness of the printing medium.

Figure 26:
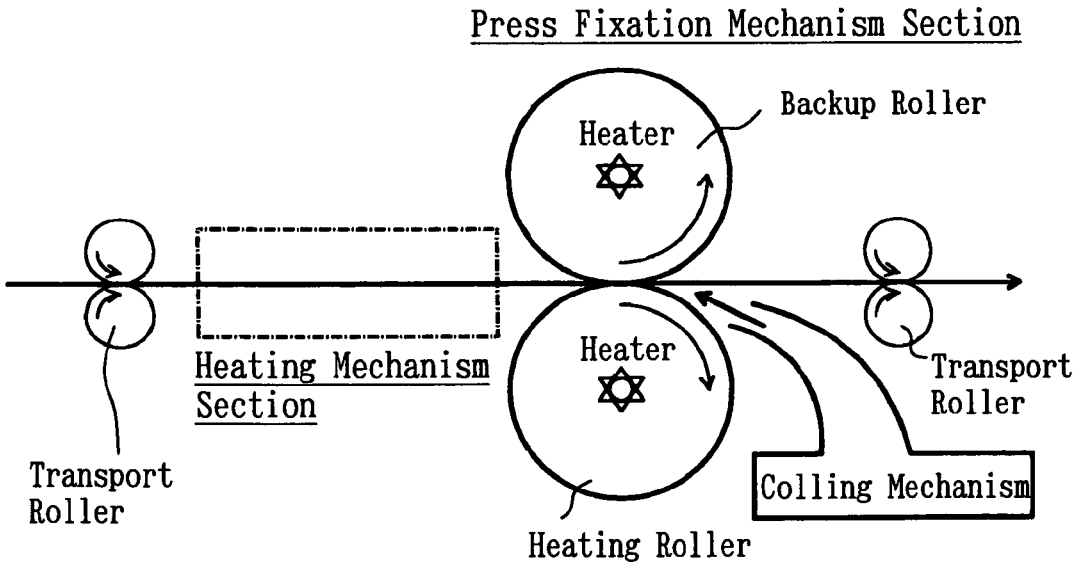
FIG. 26 is a view showing a fifth example of the fixation unit configuration.
Figure 27:
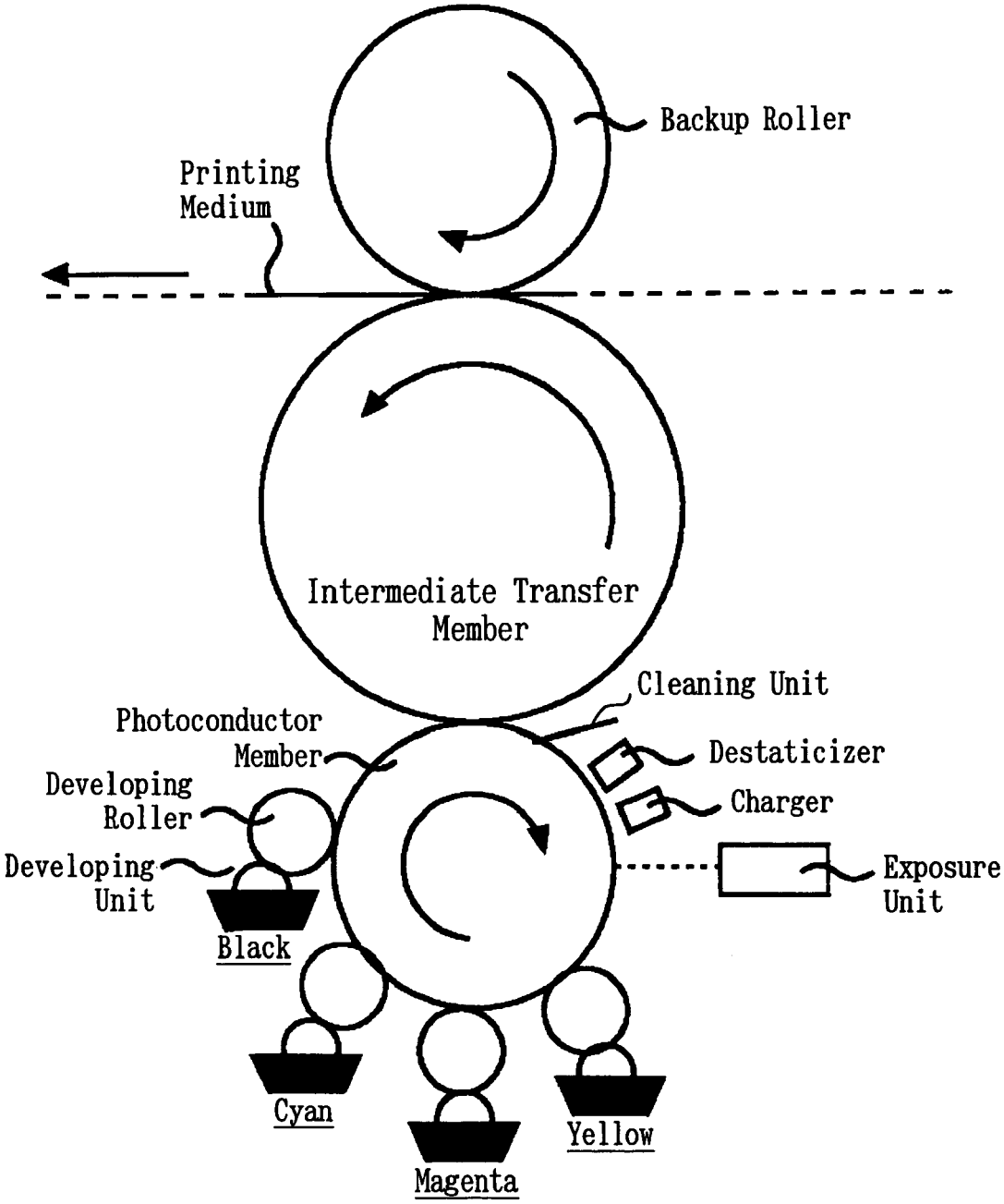
Fig.27 Prior Art
FIG. 27 is a view showing the configuration of a conventional liquid-development electrophotographic apparatus.
Figure 28:
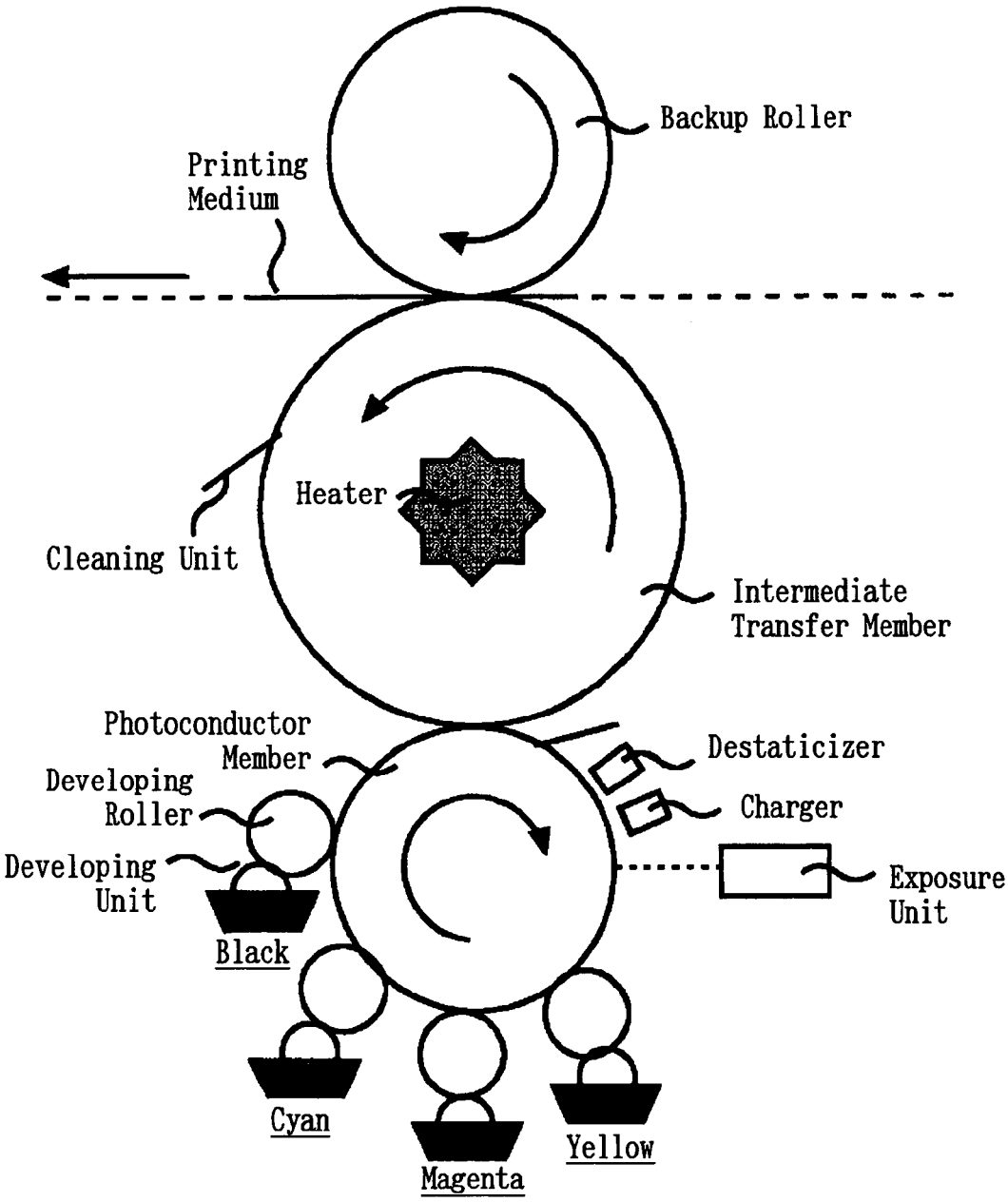
Fig.28 Prior Art
FIG. 28 is a view for explaining a conventional melt transfer-and-fixation process.
Figure 29:
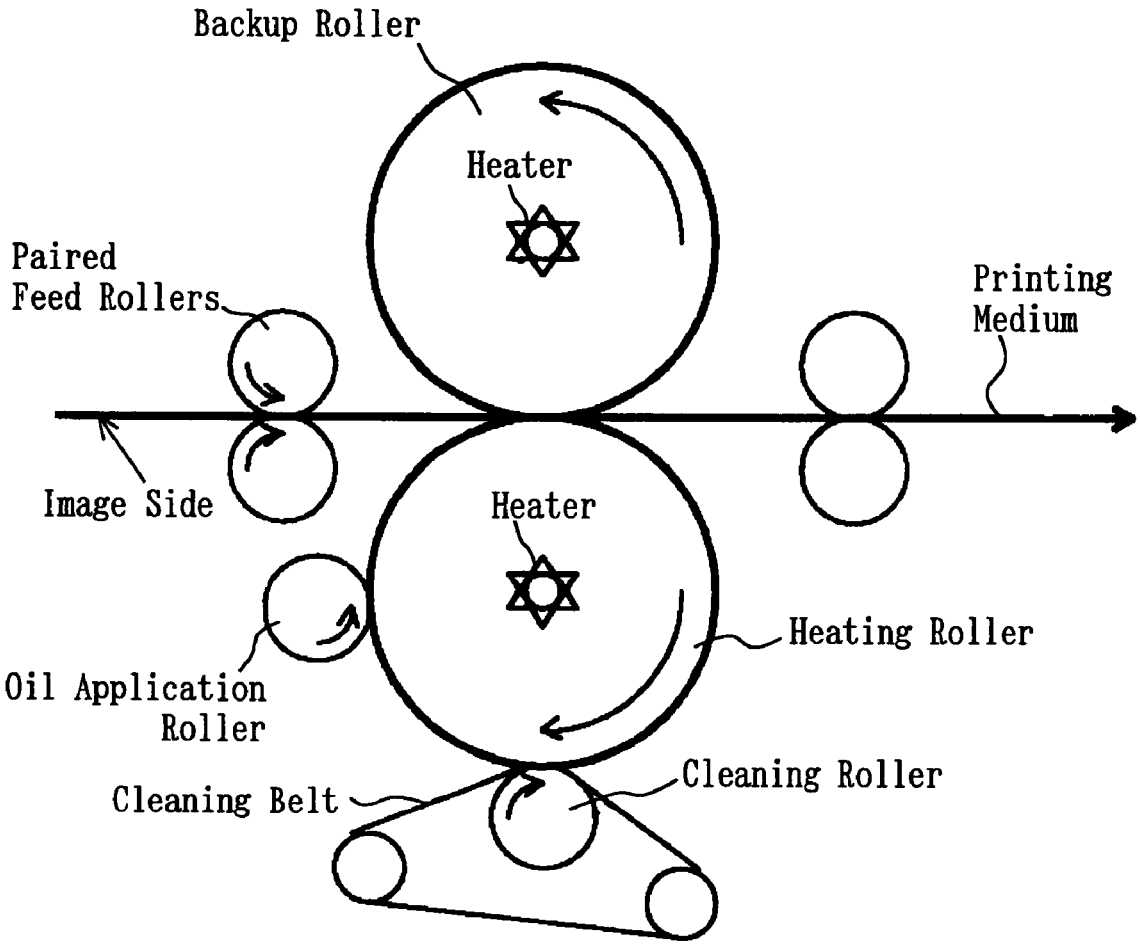
Fig.29 Prior Art
FIG. 29 is a view showing a conventional toner fixation unit for use in a full-color electrophotographic apparatus.
Figure 30:
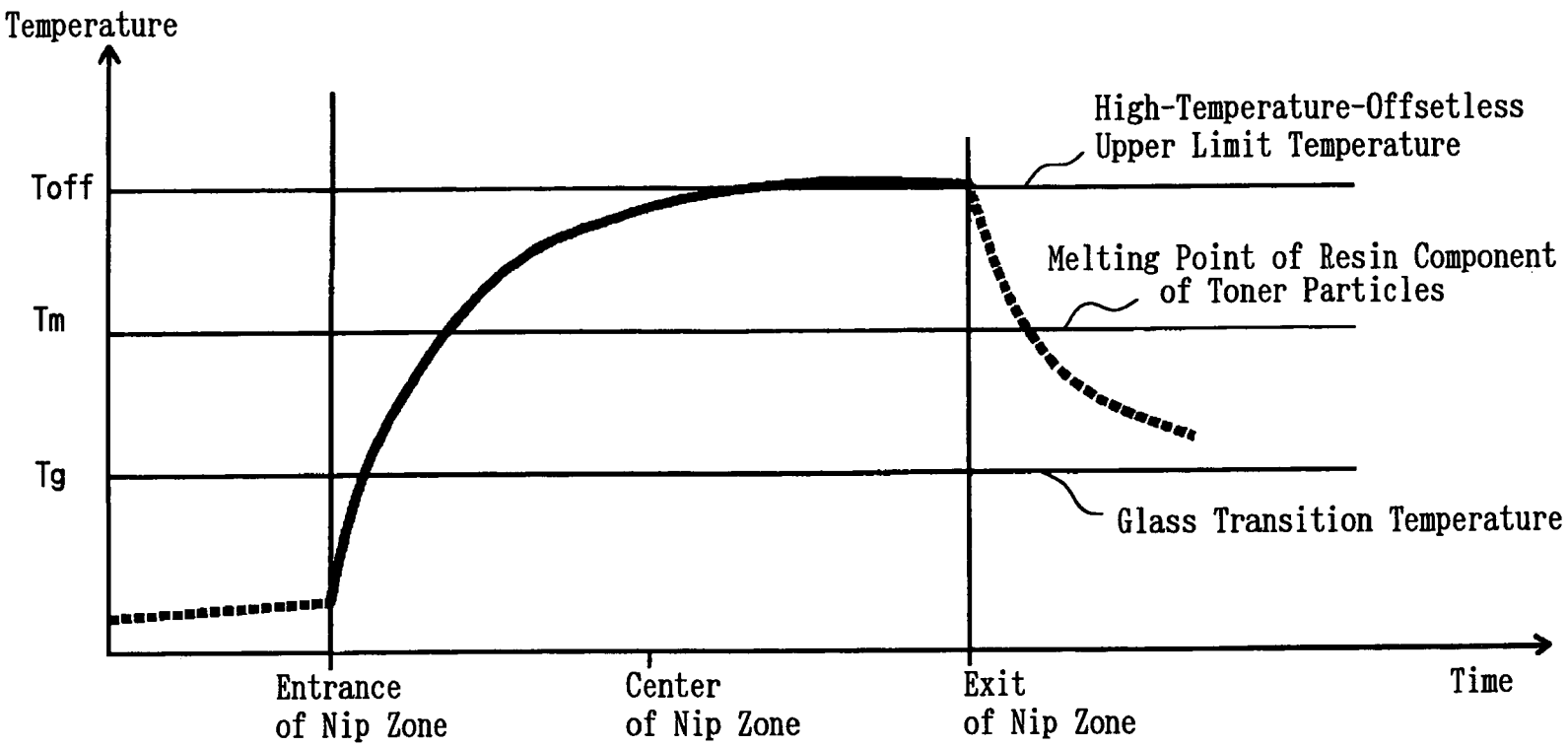
Fig.30 Prior Art
FIG. 30 is a diagram illustrating a toner and printing medium surface temperature history as observed in a conventional fixation nip zone.

FIG. 26 is a view showing a fifth example of the fixation unit configuration. As shown in FIG. 26, the press fixation mechanism provided downstream of the heating mechanism section includes a cooling mechanism for supplying cold air toward the exit of the heating roller. Cooling air is blown from the heating-roller side toward the exit of the fixation nip zone formed by the heating roller and the backup roller, so as to remove heat which accumulates on the surface of the heating roller.

The above-described configuration expectably yields the following secondary effect. The heating roller—hose temperature is controlled so as to be lower than the temperature of the printing medium—increases in temperature through thermal transmission from the printing medium. However, cooling by means of the cooling mechanism can further lower the toner image temperature at the exit of the fixation nip section.

Preferably, the surface roughness of the heating roller surface rubber material is 3 $\mu$m or less in terms of JIS 10-point average roughness (Rz). By so doing, the heating roller surface rubber material comes in microscopic contact with the toner image surface of the printing medium so as to exert a micro shear force on the toner image.

Industrial Applicability

According to the present invention, through use of a nonvolatile carrier liquid, the carrier liquid can be effectively removed without need to employ a large-scale collection apparatus, and a full-color image can be effectively transferred to a printing medium. Also, an intermediate transfer member does not need to undergo cooling before coming into contact with a photoconductor member, thereby avoiding occurrence of thermal damage to the photoconductor member.

According to the present invention, pressure to be applied at the time of transfer is lessened, and transfer and fixation are accurately and reliably carried out, thereby preventing occurrence of image distortion.

Since pressure to be applied at the time of transfer to a printing medium is low, residual toner which remains on the intermediate transfer member without being transferred does not stubbornly adhere to the surface of the intermediate transfer member, and thus can be readily cleaned off.

According to the present invention, before being transported to a transfer section, the printing medium is preheated to a temperature required for transfer such that the temperature (T1) of the printing medium as measured in the transfer section becomes higher than the softening temperature (Tg) of resin contained in a liquid toner to be used and lower than the melting temperature (Tm) of the resin. Also, the temperature (T2) of an image bearing member is controlled so as to be higher than the softening temperature (Tg) and lower than the temperature (T1) of the printing medium as measured in the transfer section. As a result, an image on the image bearing member which has undergone sufficient carrier removal can be stably and efficiently melt-transferred to the printing medium.

According to the present invention, a mixture of two types of resins of different softening temperatures is used in a nonvolatile liquid developer, and the temperature of the image bearing member is set so as to meet predetermined conditions, thereby expanding the range of temperature and carrier removal count in which good transfer efficiency is exhibited. As a result, transfer to the printing medium can be stably carried out while coping with surface conditions of the image bearing member, environmental variations, and the like, whereby a high-quality image can be stably obtained.

According to the present invention, the printing medium in an unfixed condition to which toner has been transferred undergoes the following two stages of independent processes: a medium heating process for heating toner and printing medium, and a press fixation process. By so doing, toner is melt-fixed on the printing medium. Thus, without occurrence of high-temperature offset in the fixation process, toner can be fixed on the printing medium.

What is claimed is:

1. A full-color electrophotographic apparatus to form a full color image on a printing medium using a nonvolatile, high-viscosity, high-concentration liquid toner, comprising:

an intermediate transfer member on which color toner images in a plurality of colors are sequentially superimposed so as to form the full-color image, and the full-color image being heat-melt-transferred to the printing medium;

a photoconductor member to form the color toner images, the intermediate transfer member being maintained at a temperature equal to or higher than a softening start temperature of resin contained in the liquid toner and equal to or lower than a withstand temperature of the photoconductor member;

a carrier-removing mechanism provided on the intermediate transfer member so as to remove a carrier when each of the color toner images is transferred to the intermediate transfer member, said carrier-removing mechanism comprising a carrier-removing roller to which a bias having a same polarity as that of particles of the toner on the intermediate transfer member and in rotary contact with the toner images on the intermediate transfer member so as to remove the carrier while packing the toner softened by a force of an electric field induced by the bias;

a transfer section, comprising a backup roller, to press against the printing medium the toner images which have been formed on the intermediate transfer member and from which the carrier has been removed, to thereby transfer the toner images to the printing medium;

a fixation section for fixing the transferred toner image;

means for heating, before the transfer to the printing medium, the toner images formed on the intermediate transfer member to a temperature higher than a glass transition temperature of toner solids and lower than a melting point of the toner solids, wherein a bias voltage is applied in such a direction as to transfer the toner images to the printing medium at the time of toner image transfer to the printing medium, in a zone for transferring the toner images on the intermediate transfer member to the printing medium, the backup roller applying a low pressure capable of transferring the toner images on the intermediate transfer member to the printing medium, and the fixation section is configured in such a manner as not to be drivingly linked to an image formation section including the intermediate transfer member, the photoconductor member, and a development section, to apply a sufficient pressure for enhancing cohesion of the toner to the printing medium which is insufficient at the time of transfer, while being heated to a temperature higher than the melting point of the toner solids;

means for setting temperature such that a temperature (T1) of the printing medium as measured in the transfer section is higher than a softening temperature (Tg) of the resin contained in the liquid toner to be used and lower than a melting temperature (Tm) of the resin;

a preheating unit for preheating the printing medium to a temperature required for transfer before the printing medium is fed to the transfer section; and means for controlling a temperature (T2) of the intermediate transfer member such that the temperature (T2) is higher than the softening temperature (Tg) and lower than the temperature (T1) of the printing medium as measured in the transfer section.

2. A full-color liquid-development electrophotographic apparatus as described in claim 1, wherein the preheating unit comprises a pair of rollers serving as heating rollers and a press member disposed so as to cause the printing medium to be wound on one of the paired rollers; and a temperature of the heating roller is set lower than the melting temperature (Tm) and higher than the temperature (T1) of the printing medium as measured in the transfer section, in consideration of cooling of the heated printing medium effected through heat radiation before the heated printing medium reaches the transfer section.

3. A full-color liquid-development electrophotographic apparatus as described in claim 2, wherein the press member is formed of a metal having high thermal conductivity.

4. A full-color liquid-development electrophotographic apparatus as described in claim 2, wherein the press member is a flexible member.

5. A full-color liquid-development electrophotographic apparatus as described in claim 4, wherein the flexible member and a surface of the heating roller are moved in the same direction; and when V1 represents a moving speed of the surface of the heating roller, and V2 represents a moving speed of the flexible member, V1 and V2 are controlled so as to establish the relation V2<V1.

6. A full-color electrophotographic apparatus to form a full color image on a printing medium using a nonvolatile, high-viscosity, high-concentration liquid toner, comprising:

an intermediate transfer member on which color toner images in a plurality of colors are sequentially superimposed so as to form the full-color image, and the full-color image being heat-melt-transferred to the printing medium;

a photoconductor member to form the color toner images, the intermediate transfer member being maintained at a temperature equal to or higher than a softening start temperature of resin contained in the liquid toner and equal to or lower than a withstand temperature of the photoconductor member;

a carrier-removing mechanism provided on the intermediate transfer member so as to remove a carrier when each of the color toner images is transferred to the intermediate transfer member, said carrier-removing mechanism comprising a carrier-removing roller to which a bias having a same polarity as that of particles of the toner on the intermediate transfer member and in rotary contact with the toner images on the intermediate transfer member so as to remove the carrier while packing the toner softened by a force of an electric field induced by the bias;

a transfer section, comprising a backup roller, to press against the printing medium the toner images which have been formed on the intermediate transfer member and from which the carrier has been removed, to thereby transfer the toner images to the printing medium; and a fixation section for fixing the transferred toner image, wherein a mixture of two types of resins of different softening temperatures is used as resin contained in the nonvolatile, high-viscosity, high-concentration liquid toner; and when Tg1 represents a softening temperature of one resin, Tg2 represents a softening temperature of the other resin, Tg3 represents a softening temperature of the mixed resin, Tm3 represents a melting temperature of the mixed resin, and T4 represents a temperature of the image bearing member, the two types of resins are selected so as to establish the relation Tg1<Tg3<Tg2<Tm3, and means for controlling a temperature of the intermediate transfer member is provided so as to establish the relation Tg1<T4<Tg2<Tm3.

7. A full-color liquid-development electrophotographic apparatus as described in claim 6, wherein, in addition to the means for controlling the temperature of the intermediate transfer member, means for controlling the temperature of the printing medium as measured at the time of transfer is provided so as to establish the relation Tg1<T4<Tg2<Tm3<T5, where T5 represents the temperature of the printing medium as measured at the time of transfer.

8. A full-color liquid-development electrophotographic apparatus as described in claim 6, wherein the two types of resins are prepared so as to establish the relation (T4−Tg1) <20° C. and the relation (Tg2−T4)>10° C.

9. A full-color liquid-development electrophotographic apparatus as described in claim 6, wherein the two types of resins are mixed such that a proportion of one resin to the other resin is 20% to 80%.

10. A full-color electrophotographic apparatus to form a full color image on a printing medium using a nonvolatile, high-viscosity, high-concentration liquid toner, comprising:

an intermediate transfer member on which color toner images in a plurality of colors are sequentially superimposed so as to form the full-color image, and the full-color image being heat-melt-transferred to the printing medium;

a photoconductor member to form the color toner images, the intermediate transfer member being maintained at a temperature equal to or higher than a softening start temperature of resin contained in the liquid toner and equal to or lower than a withstand temperature of the photoconductor member;

a carrier-removing mechanism provided on the intermediate transfer member so as to remove a carrier when each of the color toner images is transferred to the intermediate transfer member, said carrier-removing mechanism comprising a carrier-removing roller to which a bias having a same polarity as that of particles of the toner on the intermediate transfer member and in rotary contact with the toner images on the intermediate transfer member so as to remove the carrier while packing the toner softened by a force of an electric field induced by the bias;

a transfer section, comprising a backup roller, to press against the printing medium the toner images which have been formed on the intermediate transfer member and from which the carrier has been removed, to thereby transfer the toner images to the printing medium;

a fixation section for fixing the transferred toner image, the fixation section being separate from the transfer section, wherein the fixation section comprises a first fixation section and a second fixation section;

the first fixation section and the second fixation section are configured in such a manner as not to be drivingly linked to an image formation section including the intermediate transfer member, the photoconductor member, and a development section; and the first fixation section is configured in such a manner as to apply a sufficient pressure for enhancing toner cohesion to the printing medium which is insufficient at the time of transfer, so as to ensure fixation strength, while being heated to a temperature higher than the melting point of the toner solids; and the second fixation section is configured in such a manner as to apply pressure lower than the pressure which the first fixation section applies.

11. A full-color electrophotographic apparatus to form a full color image on a printing medium using a nonvolatile, high-viscosity, high-concentration liquid toner, comprising:

an intermediate transfer member on which color toner images in a plurality of colors are sequentially superimposed so as to form the full-color image, and the full-color image being heat-melt-transferred to the printing medium;

a photoconductor member to form the color toner images, the intermediate transfer member being maintained at a temperature equal to or higher than a softening start temperature of resin contained in the liquid toner and equal to or lower than a withstand temperature of the photoconductor member;

a carrier-removing mechanism provided on the intermediate transfer member so as to remove a carrier when each of the color toner images is transferred to the intermediate transfer member, said carrier-removing mechanism comprising a carrier-removing roller to which a bias having a same polarity as that of particles of the toner on the intermediate transfer member and in rotary contact with the toner images on the intermediate transfer member so as to remove the carrier while packing the toner softened by a force of an electric field induced by the bias;

a transfer section, comprising a backup roller, to press against the printing medium the toner images which have been formed on the intermediate transfer member and from which the carrier has been removed, to thereby transfer the toner images to the printing medium; and a fixation section for fixing the transferred toner image, wherein the fixation section comprises:

heating means for heating the printing medium to which toner has been transferred, so as to melt a resin component of toner particles; and press fixation means for fixing the toner image through causing the printing medium to pass through a fixation nip zone where pressure is applied to a resin component of toner particles molten on the printing medium, and at least a toner image side of the printing medium is heat-retained, wherein the printing medium receives heat from the heating means and the pressure from the press fixation means at different times.

12. An apparatus to form a color image on a printing medium using a liquid toner containing a resin, comprising:

a transfer member to receive the color image thereon;

a transfer unit to transfer the color image from the transfer member to the printing medium;

a temperature setting unit to set a temperature (T1) of the printing medium as measured in the transfer unit to be greater than a softening temperature (Tg) of the resin contained in the toner and lower than a melting temperature (Tm) of the resin;

a preheating unit to preheat the printing medium to a temperature required for transfer of the color image before the printing medium is received by the transfer unit; and a temperature control to control a temperature (T2) of the transfer member such that the temperature (T2) is greater than the softening temperature (Tg) and lower than the temperature (T1).

13. An apparatus to form a color image on a printing medium, comprising:

a transfer member to receive a liquid toner containing a mixed resin to thereby form the color image thereon;

a transfer unit to transfer the color image from the transfer member to the printing medium; and a temperature controller to control a temperature T4 of the transfer member, the mixed resin comprising a first resin having a softening temperature Tg1 and a second resin having a softening temperature Tg2 different from Tg1, so that Tg1<Tg3<Tg2<Tm3 is satisfied, wherein Tg3 represents a softening temperature of the mixed resin and Tm3 represents a melting temperature of the mixed resin, and the temperature controller controls the temperature T4 so that Tg1<T4<Tg2<Tm3 is satisfied.

14. An apparatus to form a color image on a printing medium using a liquid toner containing a resin, comprising:

a photoconductor member to form a plurality of images of different colors thereon;

a transfer member to receive the plurality of images to thereby form the color image thereon;

a transfer unit to transfer the color image from the transfer member to the printing medium; and a fixation unit to fix the transferred color image, comprising:

a first section to apply a first pressure to the printing medium to thereby fix the color image to the printing medium, and a second section to apply a second pressure to the printing medium which is lower than the first pressure, the first and second sections not being drivingly linked to the transfer member or the photoconductor member.

* * * * *